US006769826B2

(12) United States Patent
Ohba

(10) Patent No.: US 6,769,826 B2
(45) Date of Patent: Aug. 3, 2004

(54) CONTAINER FOR FEEDING ROD-LIKE COSMETIC MATERIAL

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/204,270

(22) PCT Filed: Oct. 25, 2001

(86) PCT No.: PCT/JP01/09388

§ 371 (c)(1),
(2), (4) Date: Aug. 20, 2002

(87) PCT Pub. No.: WO02/069752

PCT Pub. Date: Sep. 12, 2002

(65) Prior Publication Data

US 2003/0031497 A1 Feb. 13, 2003

(30) Foreign Application Priority Data

Mar. 6, 2001 (JP) ..... 2001-61772

(51) Int. Cl.[7] ..... B43K 21/08
(52) U.S. Cl. ..... 401/75; 401/68; 401/55
(58) Field of Search ..... 401/55, 68, 71, 401/73, 74, 75, 86, 87, 88

(56) References Cited

U.S. PATENT DOCUMENTS

| | | | | |
|---|---|---|---|---|
| 2,815,122 A | * | 12/1957 | Lerner et al. | 401/61 |
| 5,018,893 A | * | 5/1991 | Holloway | 401/75 |
| 5,407,286 A | * | 4/1995 | Powers | 401/68 |
| 5,547,300 A | * | 8/1996 | Powers | 401/68 |
| 6,048,122 A | | 4/2000 | Ohba | |
| 6,082,917 A | * | 7/2000 | Noguchi et al. | 401/75 |

FOREIGN PATENT DOCUMENTS

| | | |
|---|---|---|
| JP | 62-184818 | 11/1987 |
| JP | 05-032092 | 2/1993 |
| JP | 11-270651 | 10/1999 |
| JP | 2000-106946 | 4/2000 |

* cited by examiner

*Primary Examiner*—Gregory L. Huson
*Assistant Examiner*—Huyen Le
(74) *Attorney, Agent, or Firm*—Rabin & Berdo, PC

(57) ABSTRACT

A stick type cosmetic material feeding container which houses a stick type cosmetic material in such a manner that the stick type cosmetic material can be fed out prevents a spiral engagement mechanism from breaking at the uppermost limit or the like. The stick type cosmetic material feeding container further eliminates unsteadiness of the spiral engagement mechanism and can obtain the stress of slide due to the spiral engagement mechanism. A front cylinder 10 having a tip opening hole 11 through which a stick type cosmetic material advances and retreats is rotatably connected with a container body 3. A core chuck member 30 having a spiral section 34 is inserted in the container body 3 and a rotation regulating mechanism for synchronously rotating the front cylinder 10 and the core chuck member 30 is provided. Further, an elastic engagement section 68 is provided in a through hole 61 of an elastic cylindrical body 60 which rotates synchronously with the container body 3. Also, it is arranged such that a diameter of the engagement section 68 is smaller than an outside diameter of a rod 32 of the core chuck member 30 and the engagement section 68 constitutes a spiral engagement mechanism together with the spiral section 34 provided on the rod 32. Thus, when an overload is imposed on the spiral engagement mechanism at the uppermost limit or the like, the engagement section 68 is deformed, thereby preventing the spiral engagement mechanism from breaking which may occur resulting from the overload.

4 Claims, 24 Drawing Sheets

CONTAINER FOR FEEDING ROD-LIKE COSMETIC MATERIAL

TECHNICAL FIELD

The present invention relates to a stick type cosmetic material feeding container. It particularly relates to a feeding mechanism of the stick type cosmetic material feeding container.

BACKGROUND ART

A feeding mechanism of a stick type cosmetic material feeding container, as shown in Japanese Patent No. 3029834, rotatably connects a front cylinder and a container body and inserts therein a core chuck member having a cosmetic material retaining section at its front end. Further, means (rotation regulating mechanism) for synchronously rotating the front cylinder and the core chuck member are provided and also it is arranged such that the core chuck member can move in an axial direction due to a spiral engagement mechanism for spirally engaging the container body and the core chuck member.

However, the spiral engagement mechanism described above is composed of a male screw and a female screw, and in the case of an engagement of such a male screw and a female screw, it is generally inevitable that a mechanical space (clearance) will arise due to the structure. Especially in the case of forming the spiral engagement mechanism by molding using a synthetic resin or the like, it is necessary to improve the processing accuracy so as to diminish the unsteadiness. And, improvement of the accuracy causes an increase in costs.

Further, although a stick type cosmetic material reaches the uppermost limit in a stick type cosmetic material feeding container, a user sometimes applies an overload on a feeding mechanism resulting from the rotation by mistake in expectation of further feed of a core of the stick type cosmetic material.

On the contrary, it often occurs while using the stick type cosmetic material feeding container that an overload is applied by mistake in expectation of further retracting of a stick type cosmetic material, although the stick type cosmetic material has almost reached the lowermost limit. Such an overload may destroy the feeding mechanism or the stick type cosmetic material feeding container itself.

Therefore, it is set such that a prescribed durability can be obtained against the overload which exceeds a load to be put at the time of ordinary use at the uppermost limit and the lowermost limit. However, it is considered that there is nothing else to do even though the feeding mechanism or the stick type cosmetic material feeding container is destroyed when a load exceeding the prescribed durability is applied.

From this point of view, heretofore it has been known that there is a mechanism for clutching the spiral engagement of the mail screw with the female screw getting over the end of the screw thread as one of the means for preventing the spiral engagement mechanism from breaking at the uppermost limit.

However, in the spiral engagement mechanism in which an elastic deformation will not take place on mutual engagement surfaces, for example, when clutching takes place with a male screw getting over the thread of a female screw, a clutch noise arises. Such a clutch noise has an advantage of clearly notifying the uppermost limit or the like. However, there are some complaints such that the core of a stick type cosmetic material is pulled back to the inside of the container by a portion equivalent to one pitch of a screw at the time of clutching and the clutch noise itself makes a user feel unpleasant when using the cosmetic material container.

DISCLOSURE OF THE INVENTION

It is an object of the present invention to provide a stick type cosmetic material feeding container which is secured by adopting a completely new feeding mechanism capable of preventing the container from being damaged by an overload at the feed-out uppermost limit and the feed-in lowermost limit and which is more high-grade by providing the user with the sensation of smoothness in sliding when operating the feeding mechanism.

Therefore, according to the present invention, a stick type cosmetic material feeding container in which a stick type cosmetic material is housed comprising:

- a core chuck member composed of a cosmetic material retaining section for retaining the stick type cosmetic material and a spiral section which is coaxial with the cosmetic material retaining section; and
- an elastic cylindrical body whose inner circumferential surface to be spirally engaged with the spiral section is an engagement section capable of elastic deformation, wherein the stick type cosmetic material is fed out through the core chuck member due to relative rotations of the elastic cylindrical body and the core chuck member.

Further, according to the present invention, a stick type cosmetic material feeding container in which a stick type cosmetic material is housed comprising:

- a front cylinder which feeds out the stick type cosmetic material through its tip opening hole:
- a container body having means for rotatably connecting the container body to the front cylinder;
- a core chuck member composed of a cosmetic material retaining section for retaining the stick type cosmetic material and a spiral section coaxial with the cosmetic material retaining section;
- a rotation regulating mechanism for synchronously rotating the front cylinder and the core chuck member;
- an elastic cylindrical body which has a through hole having a diameter smaller than an outside diameter of the spiral section of the core chuck member;
- engagement means for synchronously rotating the elastic cylindrical body and the container body;
- an engagement section which is provided on an inner circumferential surface of the through hole and can be deformed; and
- a spiral engagement mechanism constituted by spiral engagement of the deformational engagement section and the spiral section.

Further, according to the present invention, a stick type cosmetic material feeding container in which a stick type cosmetic material is housed comprising:

- a front cylinder which feeds out the stick type cosmetic material through its tip opening hole;
- a container body having means for rotatably connecting the container body to the front cylinder;
- a core chuck member composed of a cosmetic material retaining section for retaining the stick type cosmetic material and a spiral section coaxial with the cosmetic material retaining section;
- a rotation regulating mechanism for synchronously rotating the container body and the core chuck member;

an elastic cylindrical body which has a through hole of diameter smaller than an outside diameter of the spiral section of the core chuck member;

engagement means for synchronously rotating the elastic cylindrical body and the front cylinder;

an engagement section which is provided on an inner circumferential surface of the through hole and can be deformed; and a spiral engagement mechanism constituted by spiral engagement of the deformational engagement section and the spiral section.

Further, according to the present invention, it is preferable that the spiral section of the core chuck member is a multiple-threaded screw.

Further, it is preferable that the spiral section of the core chuck member presses the engagement section, whereby a spiral engagement surface is formed.

Further, it is preferable that the engagement section is made by providing a plurality of projections on an inner circumferential surface of a through hole of the elastic cylindrical body.

Further, it is preferable that the engagement section is made by providing a spiral groove on an inner circumferential surface of the through hole of the elastic cylindrical body.

Further, it is preferable that when the front cylinder and the container body relatively rotate, the elastic cylindrical body synchronously rotates with either of the front cylinder and the container body and also the elastic cylindrical body has means for applying resistance to the relative rotations of the front cylinder and the container body.

Thus, according to the present invention, since an engagement section of an elastic cylindrical body can be deformed by elasticity, an elastic deformation takes place at the engagement section when an overload is imposed on the engagement section at the uppermost limit or the lowermost limit, whereby a spiral section races in the elastic cylindrical body. Thus, it is possible to prevent a feeding mechanism, the spiral section, and the like from breaking. Further, since it will be satisfactory if an inside diameter of the engagement section is smaller than an outside diameter of the spiral section in the relation of the deformational engagement section and the spiral section in a spiral engagement mechanism, the present invention has such an effect that it is possible to form the engagement section in various shapes within a range of satisfying the condition and it is possible to obtain the spiral engagement mechanism capable of increasing a permissible level of processing accuracy at the time of forming the engagement section.

Further, according to the present invention, in a stick type cosmetic material feeding container in which a core chuck member and a front cylinder synchronously rotate, when the front cylinder rotates with respect to a container body, a stick type cosmetic material retained by the core chuck member is fed out through a tip opening hole of the front cylinder without rotating relatively to the front cylinder, whereby no torsional stress arises when a core of the stick type cosmetic material slides in the front cylinder. Therefore, such kind of stick type cosmetic material feeding container is particularly suitable for a cosmetic material container to be used for a core of a stick type cosmetic material having a thin diameter or a core of a stick type cosmetic material having a high viscosity or being weak which might be broken due to torsion at the time of feeding out the stick type cosmetic material.

On the other hand, in the case of a stick type cosmetic material feeding container in which a container body and a core chuck member synchronously rotate, when the container body and a front cylinder are relatively rotated, a stick type cosmetic material is fed out of the front cylinder while rotating relatively to the front cylinder, whereby particularly it has the effect of being able to emphasize a cubic effect of a molded core of a lipstick or the like which is molded by die forming of a stick type cosmetic material.

Further, since a spiral section is rendered to be a multiple-threaded screw, when an elastic cylindrical body and the spiral section are spirally engaged, it is possible to have a wider spiral engagement surface without having a high thread ridge and to increase the strength of a spiral engagement mechanism as compared with a single-threaded screw of the same lead.

Further, the spiral section of the core chuck member presses an engagement section of the elastic cylindrical body, thereby forming the spiral engagement surface. Thus, friction always arises between the spiral section of the core chuck member and the elastic cylindrical body, whereby unsteadiness at the time of rotations which may mechanically occur resulting from ordinary spiral engagement of a male screw and a female screw does not arise and the sensation of smooth slide can be provided.

Further, by providing a plurality of projections on an inner circumferential surface of an elastic cylindrical body and using the projections as an engagement section, a spiral engagement surface of one of the projections formed on an inner circumferential surface of a through hole of the elastic cylindrical body is deformed and the spiral engagement is released. At the same time, another one of the projections is spirally engaged, whereby it is possible to establish a spiral engagement mechanism without interruption. Also, it is possible to minimize a clutch noise at the time of releasing the spiral engagement which is inevitable in conventional spiral engagement mechanisms and minimize a movement like pulling back a stick type cosmetic material which may take place when a male screw gets out of a top of the thread ridge of a female screw.

This can also be achieved by forming a spiral groove on an inner circumferential surface of the elastic cylindrical body and using the spiral groove as an engagement section.

Further, when the front cylinder and the container body relatively rotate, the elastic cylindrical body synchronously rotates either of the front cylinder and the container body and also the elastic cylindrical body has means for applying resistance to the relative rotations of the front cylinder and the container body. Thus, it is not necessary to have an O-ring or the like which has heretofore applied resistance when the front cylinder and the container body relatively rotate. Further, the elastic cylindrical body gets involved with the rotations of the front cylinder, the container body, and the core chuck member, whereby it is possible to prevent these members from being unsteady.

BEST MODE FOR CARRYING OUT THE INVENTION

Figure 1:
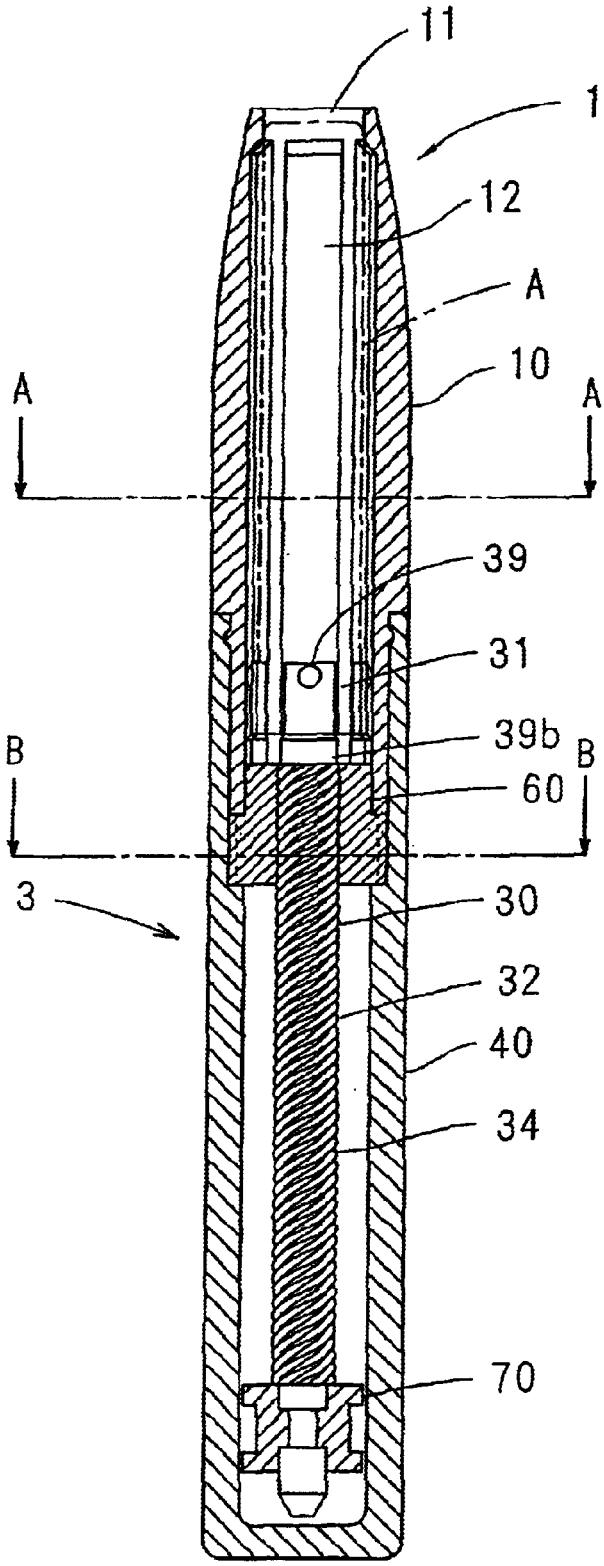
FIG. 1 is a vertical sectional view showing a stick type cosmetic material feeding container according to a first embodiment of the present invention.

Terminology and the like to be used in the present invention will be explained.

(1) With Regard to a Strain (Deformation) and an Elastic Deformation

A strain (deformation) to be stated in the present invention means two aspects, namely, a permanent strain and an elastic strain. The permanent strain means a portion of strain (deformation) which remains even after a stress imposed is gone, such as in the case that the stress is over a certain limit (elastic limit), and the elastic strain means a strain (deformation) which disappears when the stress is gone. And, an elastic deformation means a deformation which only the elastic strain arises.

(2) With Regard to Spiral Engagement

Generally, the function of spiral engagement is described using a principle of bevel (wedge). However, in the present invention, spiral engagement means that a flank (side surface) of a male screw (spiral section) having an inclination at a lead angle engages with a side surface (spiral engagement surface) of a female screw (engagement section) while rotating itself and pressing the side surface of the female screw (3) With Regard to Spiral Engagement Surfaces With regard to the spiral engagement surface described above, there are two spiral engagement surfaces. One is a spiral engagement surface constituted by a side surface of a groove (female screw) which is formed by deformation of an elastic cylindrical body when a male screw is threaded to the elastic cylindrical body. The other is a spiral engagement surface constituted by a side surface of a spiral engagement projection which has already been installed on an inner circumferential surface of the elastic cylindrical body.

(4) With Regard to a Diameter of a Through Hole (Engagement Section)

In the present invention, an inside diameter of a through hole of the elastic cylindrical body at which the spiral engagement surface described above is formed is smaller than an outside diameter of the spiral section provided at a rod which is situated under a core chuck member. Further, if a projection (engagement section) or the like is formed on its inner circumferential surface, a diameter of a tip of the projection on its inner circumferential side will be a diameter of the through hole.

(5) With Regard to Racing

In the present invention, a spiral engagement mechanism is constituted by the flank of the male screw and the spiral engagement surface of the female screw (engagement section). When an overload is put on at the uppermost limit or the like of a feeding mechanism, a spiral engagement is released by deformation of the spiral engagement surface of the engagement section of the elastic cylindrical body described above. Racing means that at this time, the core chuck member does not move in an axial direction, but the core chuck member and the elastic cylindrical body relatively rotate in a stick type cosmetic material feeding container.

(6) With Regard to a Material of the Elastic Cylindrical Body

A material of the elastic cylindrical body is a rubber elastic body, such as NR, NBR, silicone rubber, and EPT, or elastomer, or elastic foam polymer and the like, or an elastic material including a sponge-shaped substance, and a sintered madreporic body, and a three dimensional metallic madreporic body.

(7) With Regard to an Elastic Body Which is Suitable for a Through Hole at Which a Spiral Engagement Surface has not been Previously Formed Using a Projection or the Like In the case that a female screw is formed, an elastic body having physical properties that an elastic strain is slowly dissolved in a long period is especially suitable. In other words, in the case that a female screw is formed at an engagement section on an inner circumferential surface of a through hole by a spiral section (male screw) of a core chuck member and a spiral engagement surface is formed, if a material of an elastic cylindrical body has physical properties that an elastic strain is dissolved in a short period earlier than a flank (side surface) of a male screw pushes up the spiral engagement surface on which the female screw is formed, the spiral engagement surface will be actually deformed into a flat surface earlier than the flank (side surface) of the male screw pushes up the spiral engagement surface on which the female screw is formed although it looks like being spirally engaged, whereby a spiral engagement mechanism cannot be constituted. Thus, the core chuck member cannot be fed out. Therefore, such a material is not suitable for an elastic cylindrical body of a through hole (for example, a hole having a simple cylindrical shape) whose engagement section is not formed in a shape of projection.

On the other hand, in the case of the elastic cylindrical body having physical properties that the elastic strain is slowly dissolved in a long period, since the spiral engagement surface of the female screw whose thread ridge is formed by the spiral section is not completely dissolved while the flank of the male screw of the core chuck member is pushing up the female screw, the spiral engagement mechanism is constituted by the elastic cylindrical body and the core chuck member, whereby it is possible to feed out the core chuck member. Therefore, it is suitable for an elastic cylindrical body having a through hole on which a spiral engagement surface is not formed previously.

(8) With Regard to the Number of Threads of the Screw at the Spiral Section and a Lead l and a Pitch p Relation of the number of threads of the screw to the lead l and the pitch p is such that in the case of a single-threaded screw, 1 equals p, and in the case of eight-threaded screw, 1 equals 8p. Based on the lead l, it is determined how much the core of a stick type cosmetic material is fed out when a user gives a turn to the front cylinder with respect to the container body. Thus, this has a great influence on the sensation of use in the case of a cosmetic material container.

Further, in the present invention, a multiple-threaded screw means a screw which has a plurality of threads more than or equal to 2(1=2p).

Next, a first embodiment of the present invention will fully be described with reference to the accompanying drawings. FIGS. 1 through 7 show a stick type cosmetic material feeding container 1 according to the first embodiment.

As shown in FIG. 1, in the stick type cosmetic material feeding container 1 according to the first embodiment, a front cylinder 10 having at its tip a tip opening hole 11 through which a stick type cosmetic material A advances and retreats is rotatably connected with a container body 3 having an external cylinder 40, and a core chuck member 30 having a cosmetic material retaining section 31 for retaining the stick type cosmetic material A and an elastic cylindrical body 60 which is spirally engaged with the core chuck member 30 are housed therein.

Figure 2:
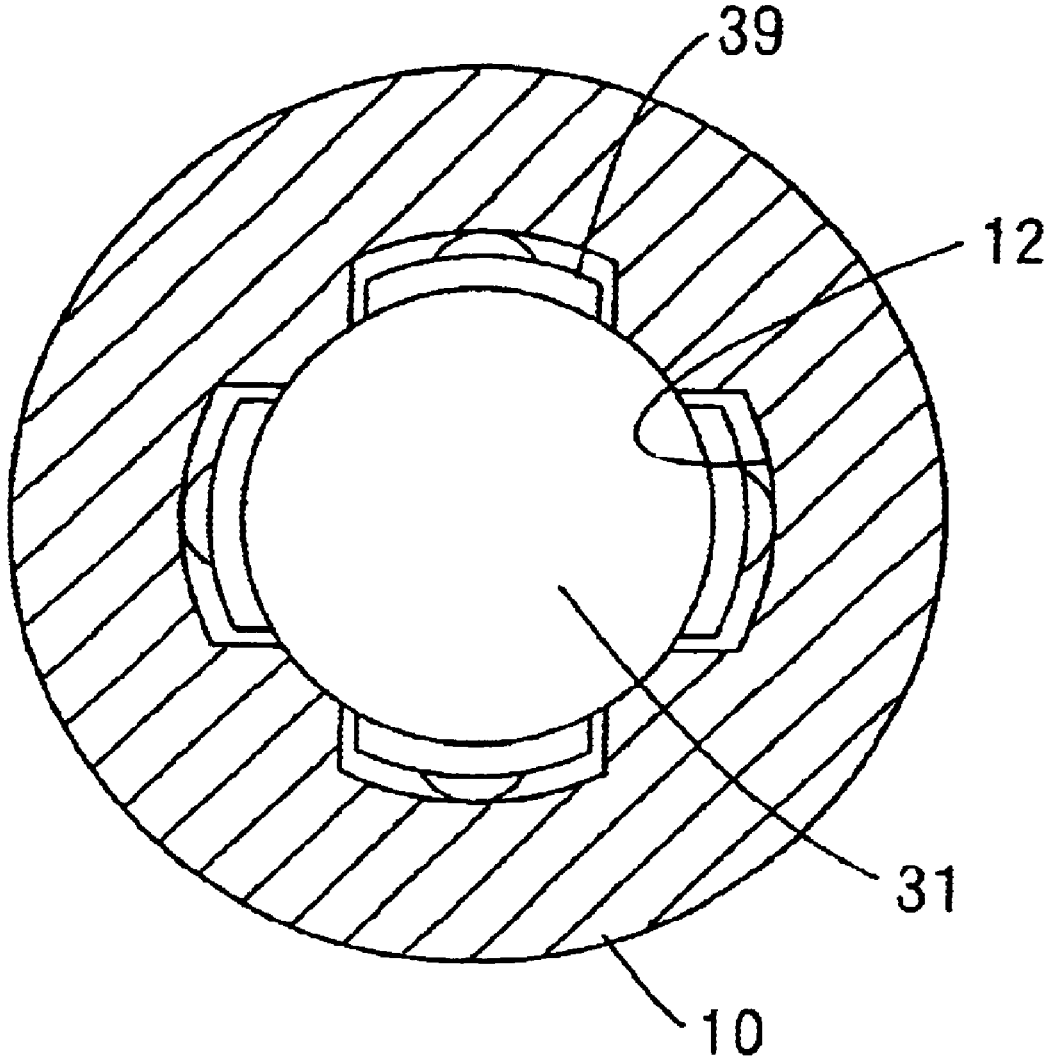
FIG. 2 is a sectional view taken along line A—A shown in FIG. 1.
Figure 3:
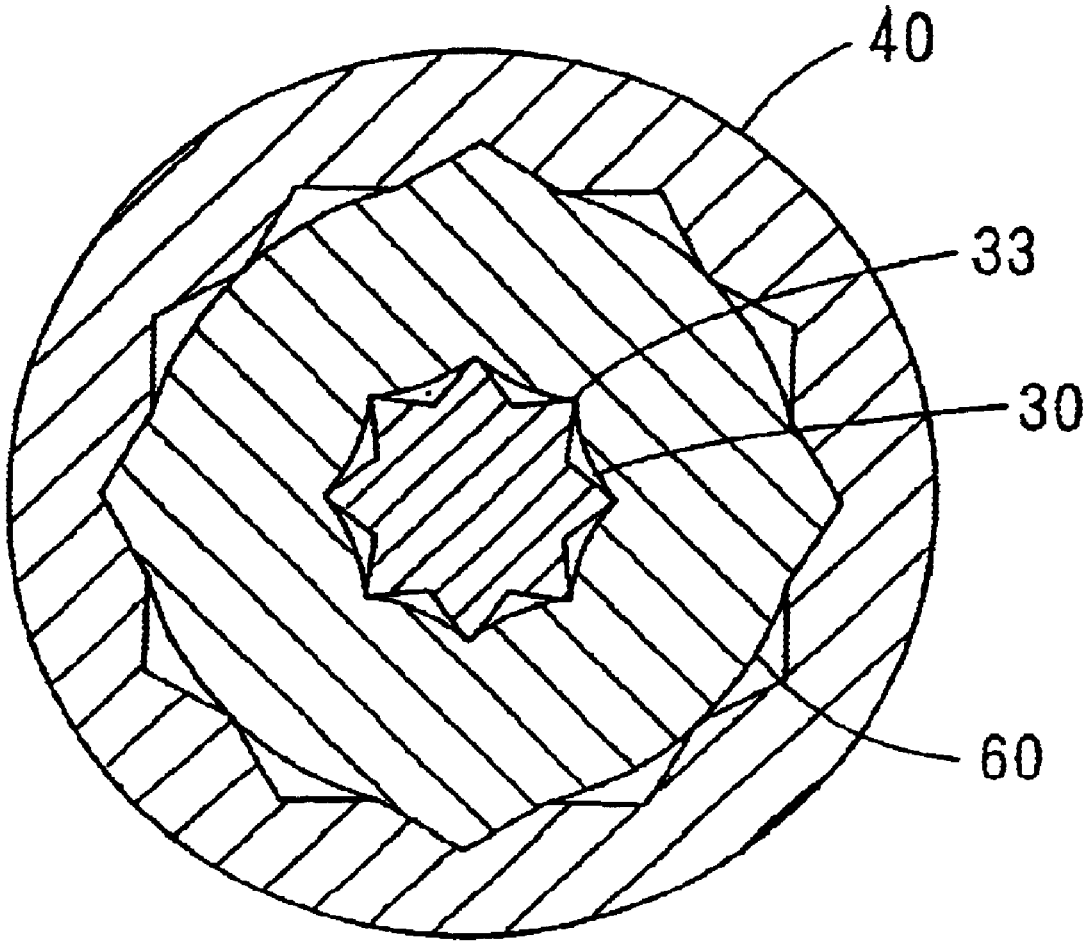
FIG. 3 is a sectional view taken along line B—B shown in FIG. 1.
Figure 5:
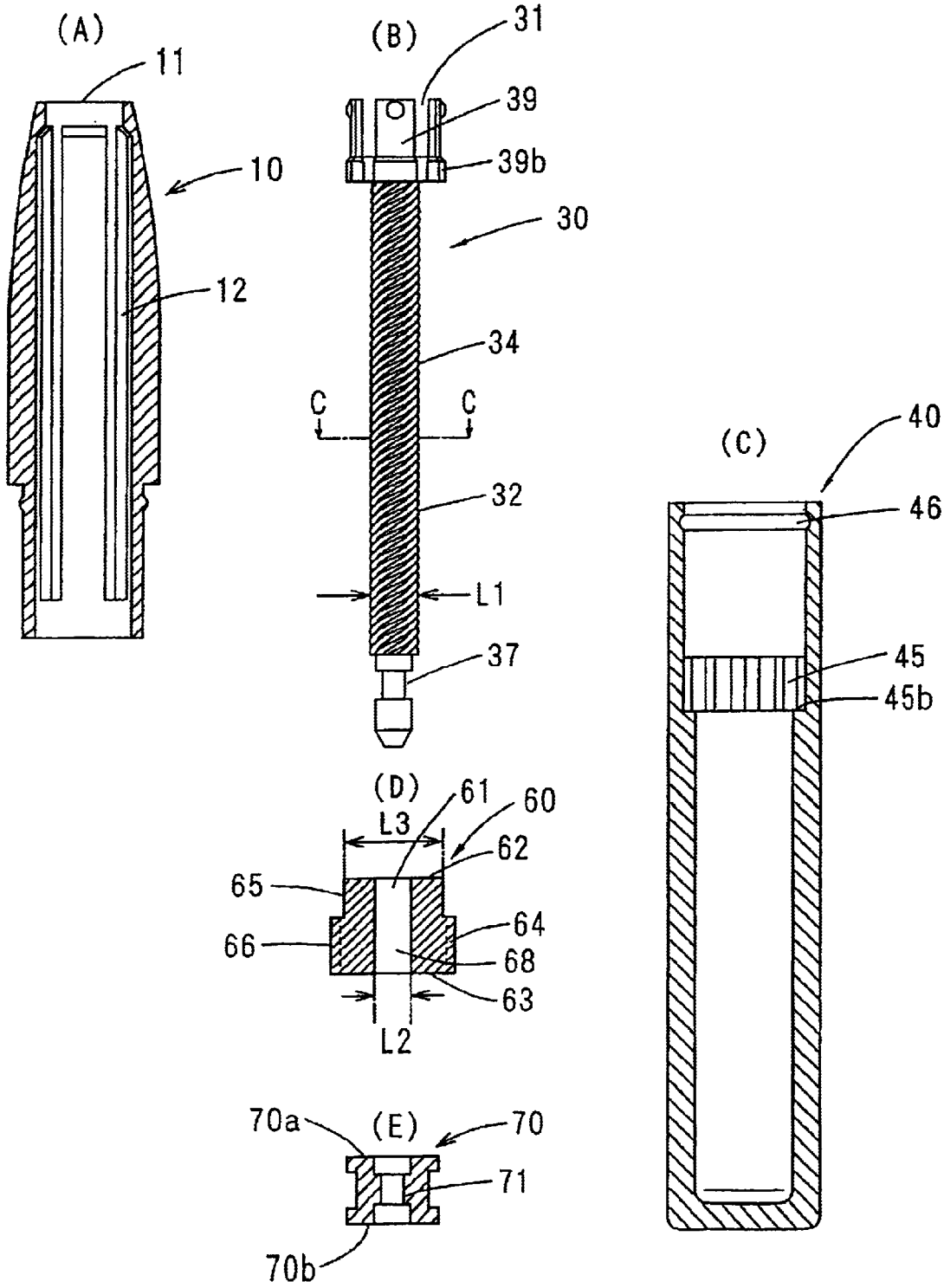
FIG. 5 is an exploded view of the first embodiment, and its (A), (B), (C), (D), and (E) are partially vertical sections showing a front cylinder, a core chuck member, an external cylinder, an elastic cylindrical body, and a stopper member, respectively.

The cosmetic material retaining section 31 on the tip side of the core chuck member 30 is provided with a claw 39 for retaining the stick type cosmetic material A. As shown in FIG. 5, at a lower part of the claw 39, an engagement section 39*b* slightly wider than the claw 39 is installed. The engagement section 39*b* is engaged with a slide groove 12 of the front cylinder 10 in such a manner that the engagement section 39*b* can slide in an axial direction, but cannot rotate, thereby constituting a rotation regulating mechanism as shown in FIG. 2 or FIG. 5(A).

Figure 6:
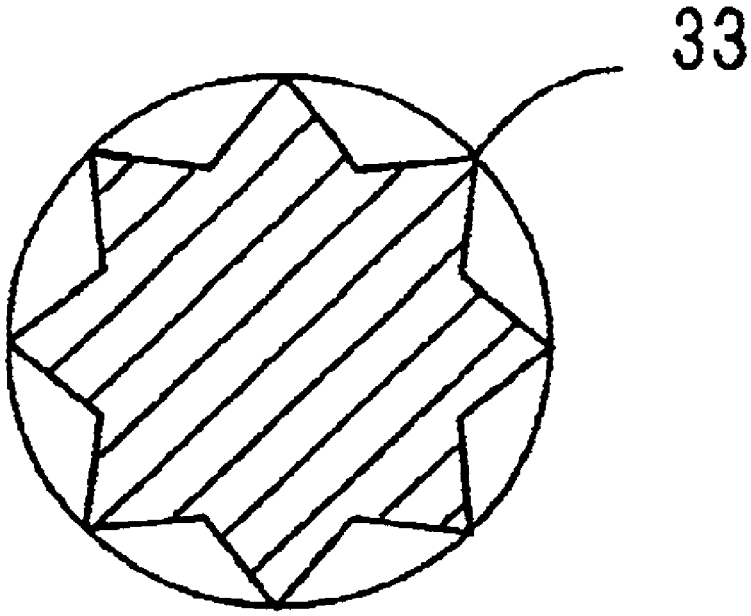
FIG. 6 is a sectional view taken along line C—C of FIG. 5(B).
Figure 7:
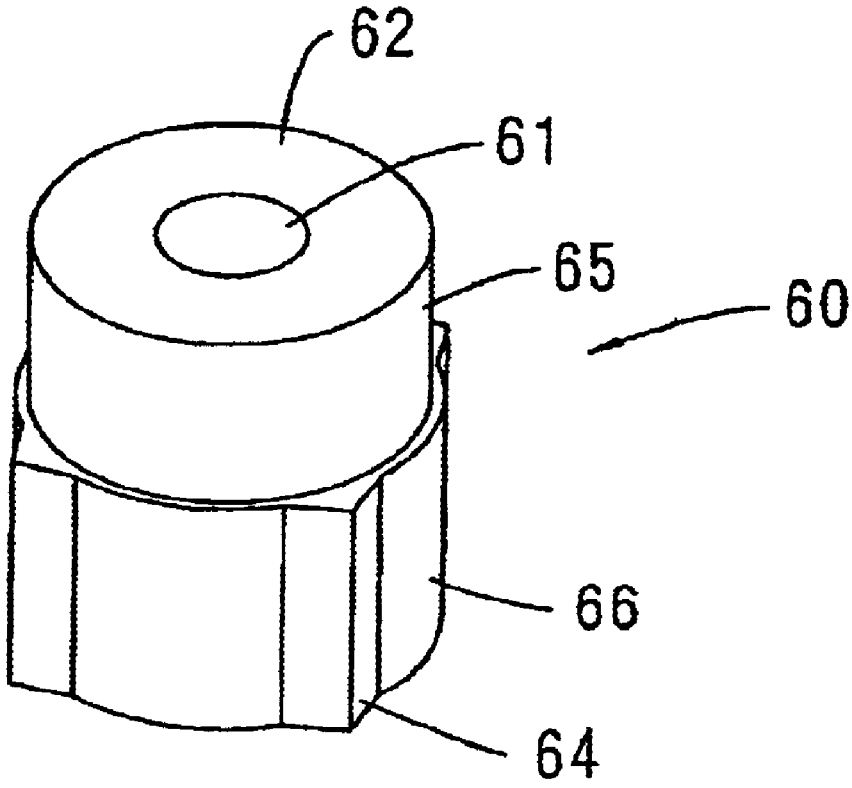
FIG. 7 is an elevation view showing the elastic cylindrical body of FIG. 5(D).

At the core chuck member 30, a rod 32 is coaxially formed running in a line with the cosmetic material retaining section 31. At an outer circumference of the rod 32, a spiral section 34 which is spirally engaged with the elastic cylindrical body 60 is formed. The spiral section 34 has a spline-shaped convex apex 33 in which an apex of a spiral is formed like an angle. The spiral section 34 is formed as a multiple-threaded screw which a lead is integer multiples of a pitch as shown in FIG. 6, and an eight-threaded screw is adopted into the spiral section 34 in this embodiment.

A concave circular section 37 is provided at a lower end of the rod 32, and an inner projection section 71 of a stopper member 70 fits in the concave circular section 37.

Next, a through hole 61 is formed in the elastic cylindrical body 60 which rotates synchronously with the external cylinder 40, and an inside diameter of the through hole 61 manufactured is size L2 which is smaller than an outside diameter L1 of the rod 32 of the core chuck member 30. An inner circumferential section of the through hole 61 is formed as an engagement section 68 in which an elastic deformation will take place. The spiral section 34 of the core chuck member 30 is spirally engaged with the engagement section 68, whereby a spiral engagement mechanism is constituted.

In this case, when the spiral section 34 is threaded into the engagement section 68, a female screw is formed on its inner circumferential surface, whereby a spiral engagement mechanism is constituted. When the front cylinder 10 and the external cylinder 40 are relatively rotated, due to a feeding mechanism composed of the rotation regulating mechanism and the spiral engagement mechanism, the core chuck member 30 for retaining the stick type cosmetic material A advances and retreats.

In this embodiment, into the spiral section 34 which is spirally engaged with the elastic cylindrical body 60, a multiple-threaded screw (eight-threaded screw) which a lead l (a distance of the movement at the time of a single rotation) is eight times as much as a pitch p (a distance between a thread ridge and a thread ridge) is adopted as described above. One of the reasons is that the spiral engagement mechanism constituted by the multiple-threaded screw has high intensity in the spiral engagement with the elastic cylindrical body 60.

Intensity of the spiral engagement mechanism will be described with reference to FIG. 8 which is a development of the through hole 61 of the elastic cylindrical body 60. Incidentally, an alternate long and short dash line 33*a* shows a locus of a convex apex of the single-threaded screw, and the alternate long and short dash line 33*a* in combination with an alternate long and two short dashes line 33*b* shows a locus of a convex apex of the eight-threaded screw.

Heretofore, as far as the intensity of the spiral engagement mechanism in a cosmetic material container is concerned, even a spiral engagement mechanism constituted by a single-threaded screw has been satisfactory because it is made from a material, such as plastic, which elasticity can be disregarded.

However, this embodiment is characterized in that a spiral engagement surface of the engagement section 68 which constitutes a female screw is easily deformed by elasticity. Thus, in the case of the single-threaded screw (the alternate long and short dash line 33*a*), a load is intensively on a spiral engagement surface of a projection 67*a* on the side of the elastic cylindrical body which will spirally be engaged if a load is applied while makeup is put on. Depending on the elasticity of the projection 67*a*, the spiral engagement surface is deformed and the core chuck member might fall into the container body due to the load at the time of makeup.

Thus, it is preferable in terms of a stability of the feeding mechanism that the spiral engagement surface is widened and the load is dispersed.

Then, as a method of securing a large area for a spiral engagement surface of different screws having identical leads, means for making a thread ridge high and means for utilizing a multiple-threaded screw adopted in this embodiment have been contrived. However, if the thread ridge is made high, it will be necessary to make a diameter of the spiral section thick or it may cause a problem such that a strain at the elastic cylindrical body 60 becomes great.

Thus, in this embodiment, the multiple-threaded screw is adopted as effective means for dispersing a load in spite that the multiple-threaded screw has the same lead as that of a single-threaded screw.

Figure 8:
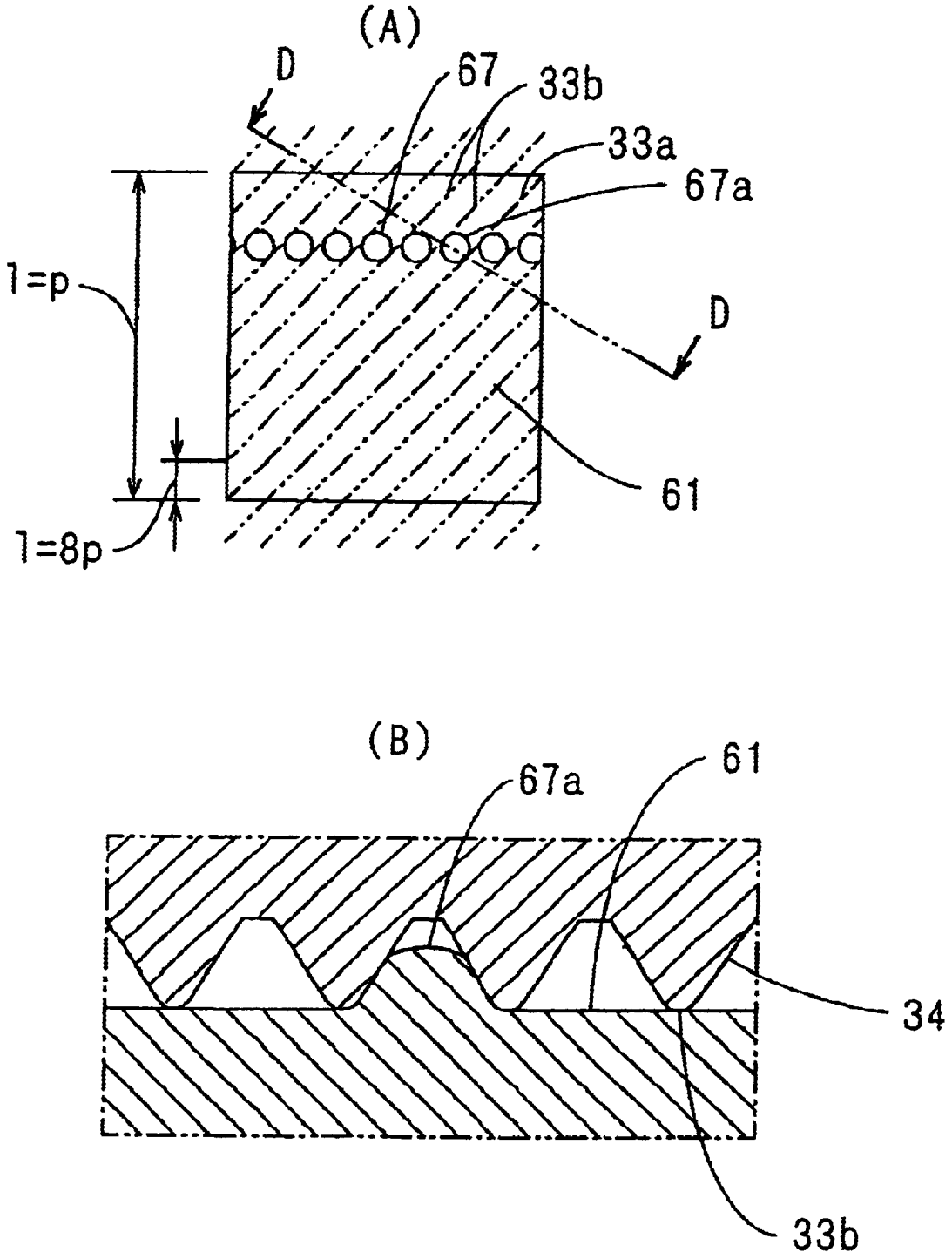
FIG. 8(A) is a development showing a through hole of the elastic cylindrical body which is used in the first embodiment.
FIG. 8(B) is a sectional view taken along line D—D of FIG. 8(A).

More specifically, even though the leads are identical, as long as heights of the thread ridges are identical, for example, the eight-threaded screw (a combination of the alternate long and short dash line 33*a* and the alternate long and two short dashes line 33*b* shown in FIG. 8) can obtain a spiral engagement surface eight times as large as a spiral engagement surface obtained by the single-threaded screw (the alternate long and short dash line 33*a* shown in FIG. 8). Thus, it has the advantage of intensity.

The elastic cylindrical body 60 has a front cylinder fitting section 65 which rotates mutually with the front cylinder 10 in the front cylinder 10 as shown in FIG. 5. Thus, by appropriately setting the size L3 of its outside diameter, the front cylinder fitting section 65 is caused to be inserted into and meet the front cylinder 10, whereby it is possible to give resistance by appropriate rotary friction when the front cylinder 10 and the container body 3 relatively rotate.

The elastic cylindrical body 60 is placed on a step section 45*b* which is installed in the external cylinder 40, and also a vertical rib 64 installed at an outer circumference of the elastic cylindrical body 60 is engaged with a spline engagement section 45 installed on an inner circumferential surface of the external cylinder 40. Thus, relative rotations are prevented.

An operative condition of the stick type cosmetic material feeding container 1 as shown in FIG. 1 will subsequently be described.

First, when the front cylinder 10 is rotated with respect to the external cylinder 40 which is the container body 3, due to a rotation regulating mechanism constituted by the engagement section 39*b* of the core chuck member 30 which is engaged with the slide groove 12 of the front cylinder 10, the front cylinder 10 and the core chuck member 30 synchronously rotate, in other words, identically rotate.

On the other hand, due to engagement of the spline engagement section 45 of the external cylinder 40 and the vertical rib 64 of the elastic cylindrical body 60.

The rod 32 of the core chuck member 30 penetrates the through hole 61 of the elastic cylindrical body 60, and the spiral section 34 of the rod 32 and the elastic engagement section 68 provided on an inner circumferential surface of the through hole 61 constitute the spiral engagement mechanism. Thus, the core chuck member 30 moves in an axial direction due to operation of the feeding mechanism while rotating with respect to the elastic cylindrical body 60. At the same time, the stick type cosmetic material A whose tail section is retained by the cosmetic material retaining section 31 starts projecting through the tip opening hole 11.

In the spiral engagement mechanism according to this embodiment, the spiral section 34 of the core chuck member 30 is spirally engaged with the engagement section 68 provided on an inner circumferential surface of the through hole 61 of the elastic cylindrical body 60 having no projections on its inner circumferential surface as shown in FIG. 5. The relation between the spiral section 34 and the through hole 61 at this time is such that since a diameter of the through hole 61 is smaller than that of the spiral section 34, when the spiral section 34 is threaded into the through hole 61 at the time of installation in the same manner as that of a wood screw, the convex apex 33 of the spiral section 34 presses the engagement section 68 installed on an inner circumferential surface of the through hole 61 and a female screw which is not shown in the drawings is formed, thereby forming the spiral engagement surface in the through hole 61. The spiral engagement surface formed and a flank of the male screw of the spiral section 34 are spirally engaged, whereby the spiral engagement mechanism is established.

If the female screw is formed at the engagement section 68 of the through hole 61 at this time, a strain (elastic deformation) will arise. It is justifiable that a part of the strain exceeds the elastic limit and becomes a permanent strain. However, it is preferable for a material to have physical properties that the strain is slowly released over a long period.

In this embodiment, when the female screw is formed at the engagement section 68 of the through hole 61, the rod 32 of the core chuck member 30 always slides in the through hole 61 of the elastic cylindrical body 60 while causing elastic deformation of the engagement section 68. Thus, unsteadiness will not arise and frictional resistance will arise at the time of feed-out.

Figure 4:
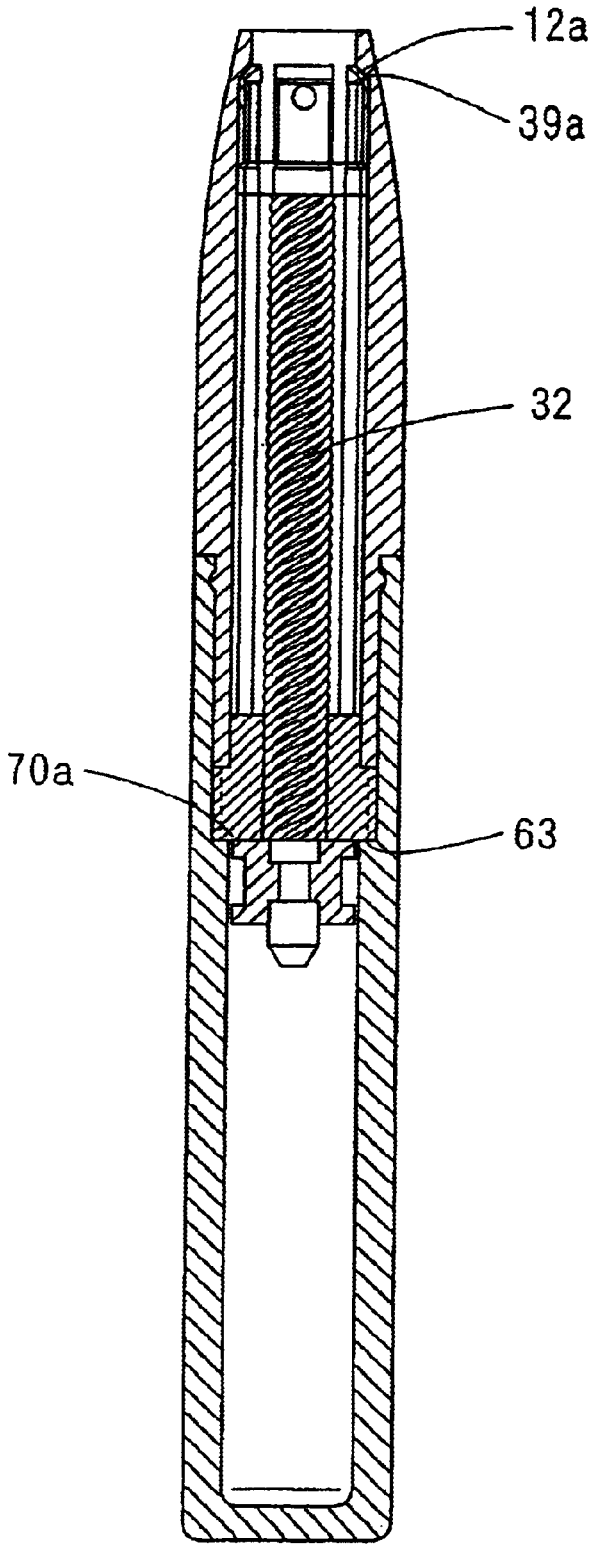
FIG. 4 is a vertical sectional view showing a state of the uppermost limit according to the first embodiment.

FIG. 4 shows a state that the core chuck member 30 is fed out to the uppermost limit. The stopper member 70 connected to a rear end of the core chuck member 30 is the uppermost limit which its upper end surface 70*a* comes into contact with a lower end surface 63 of the elastic cylindrical body 60. When the core chuck member 30 is rotated so as to feed it out further at this time and an overload is imposed on the spiral engagement mechanism, elastic deformation takes place at a spiral engagement surface of the engagement section 68 and the elastic cylindrical body 60 and the core chuck member 30 race, thereby preventing the stick type cosmetic material feeding container 1 from breaking.

Further, when the container body 3 is rotated in a direction reverse to the direction at the time of feed-out with respect to the front cylinder 10, the stick type cosmetic material A retreats in the front cylinder 10 due to the feeding mechanism and a rear end of the engagement section 39*b* of the core chuck member 30 comes into contact with an upper end surface of the elastic cylindrical body 60, whereby the lowermost limit which is a state shown in FIG. 1 is defined.

Further, as shown in FIGS. 8(A) and 8(B), a plurality of projections 67 are formed on an inner circumferential surface of the through hole 61 of the elastic cylindrical body 60 at an interval equal to the spiral engagement pitch, thereby constituting the engagement section 68. It is justifiable that the engagement section 68 is then spirally engaged with the spiral section 34 of the core chuck member 30, thereby constituting the spiral engagement mechanism.

Figure 9:
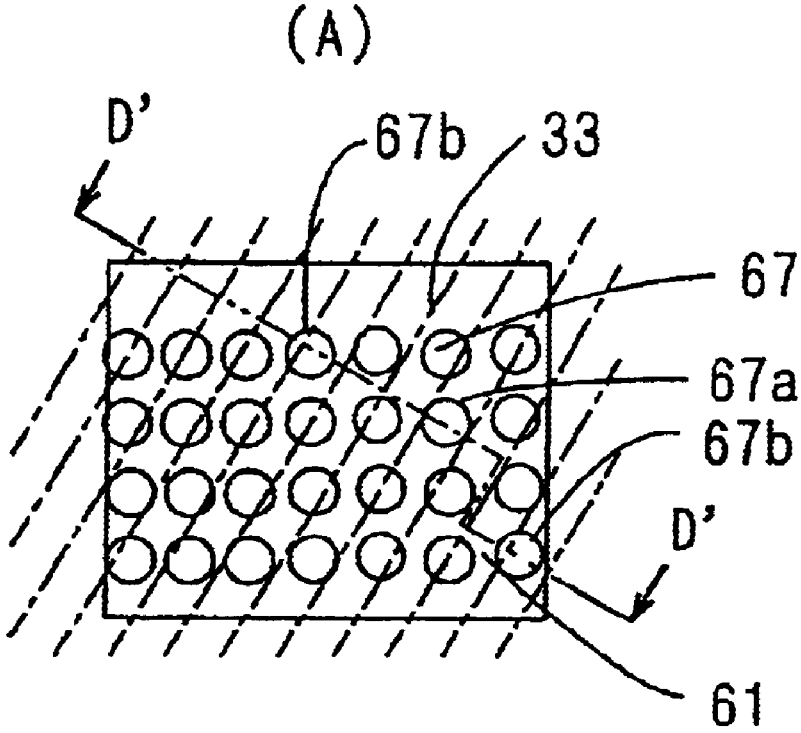
FIG. 9(A) is a development showing another example of the through hole of the elastic cylindrical body.
FIG. 9(B) is a sectional view taken along line D'—D' of Fig. (A).
Figure 9:
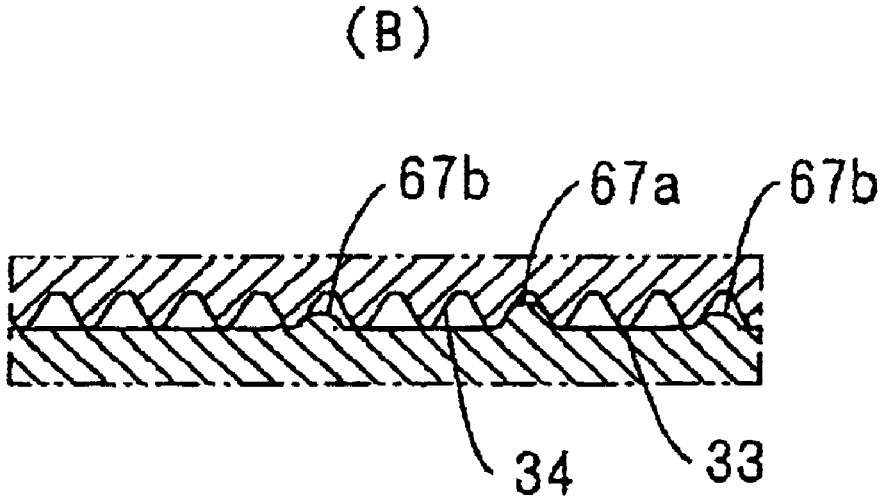

Further, the engagement section 68 on the inner circumferential surface of the through hole 61 of the elastic cylindrical body 60 may be the projections 67 arranged at random regardless of a lead and a pitch of the male screw as shown in FIGS. 9(A) and 9(B). If, for example, the projections 67*a* and 67*b* out of the projections 67 arranged at random are spirally engaged with the convex apex 33 of the spiral section 34 of the core chuck member 30 and a spiral engagement surface is formed, the spiral engagement mechanism will be established. Further, the engagement section 68 to be formed on an inner circumferential surface of the through hole 61 of the elastic cylindrical body 60 is not limited to an approximately hemispheric projection. It may be a convex thread, a triangular pyramid, or a cone.

In such an engagement section 68, it is possible to continuously create the spiral engagement surface at the time of racing, whereby the sensation of awkwardness which the user feels when the female screw climbs over the male screw can extremely be reduced. Also, it is possible to provide a stick type cosmetic material feeding container which is durable and provides the completely new sensation of handling because even though a part of the projections 67 is worn away, another projection 67 can constitute the spiral engagement mechanism.

A first advantage of the feeding mechanism according to this embodiment is as follows. In the spiral engagement mechanism according to this embodiment, it is not necessary to form an ordinary female screw, and further alignment of a male screw and a female screw is not required. Merely by making a diameter of the through hole 61 smaller than that of the spiral section 34 of the rod 32, extremely accurate relation between the male screw and the female screw can be obtained and also the through hole 61 of the elastic cylindrical body 60 can always give frictional resistance to the rod 32 of the core chuck member 30. Thus, it is possible to minimize mechanical unsteadiness at the time of rotation which inevitably arises resulting from the spiral engagement of the ordinary female screw and the male screw, whereby a user can feel the sensation of smooth slide.

A second advantage is that as countermeasures against the overload which causes the core chuck member 30 to rotate for the further movement of the core chuck member 30 at the feed-out uppermost limit or the feed-in lowermost limit, the rod 32 of the core chuck member 30 races in the through hole 61 of the elastic cylindrical body 60, thereby preventing the container body from breaking or disjointing which has been inevitable due to the overload in the case of conventional containers.

Heretofore, in the case that breakdown or disjointing of the container body due to the overload is inevitable for a structural reason, proper endurance intensity has been previously set as a reference value, and it has been considered to be such a phenomenon that breakdown of the container is inevitable when force exceeding the set value is imposed.

Further, the race is performed resulting from elastic deformation of the engagement section 68 of the elastic cylindrical body 60. Thus, no clutch noise like "ticktack" is made, unlike the conventional clutch mechanisms, whereby the sensation of high quality in using is secured.

A third advantage is that when the front cylinder 10 and the external cylinder 40 are relatively rotated, frictional resistance is applied to the elastic cylindrical body 60 according to this embodiment, whereby the stick type cosmetic material A is prevented from inadvertently projecting through the tip opening hole 11 of the front cylinder 10 which may occur resulting from oscillation caused by transportation or movement. Thus, this brings excellent results such that a lock mechanism for that purpose is not required and the container which is safe from a rotation load can be provided.

Figure 10:
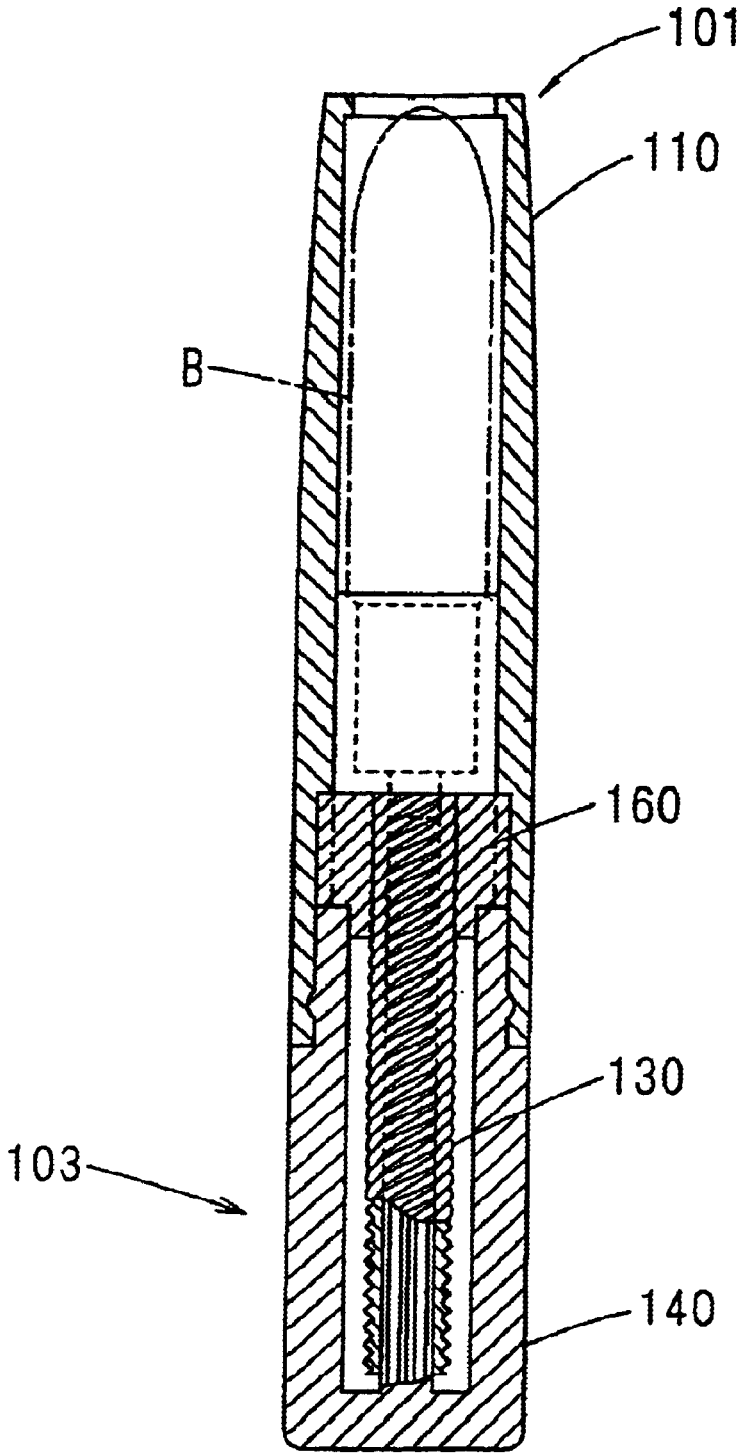
FIG. 10 is a vertical sectional view showing a stick type cosmetic material feeding container according to a second embodiment of the present invention.
Figure 11:
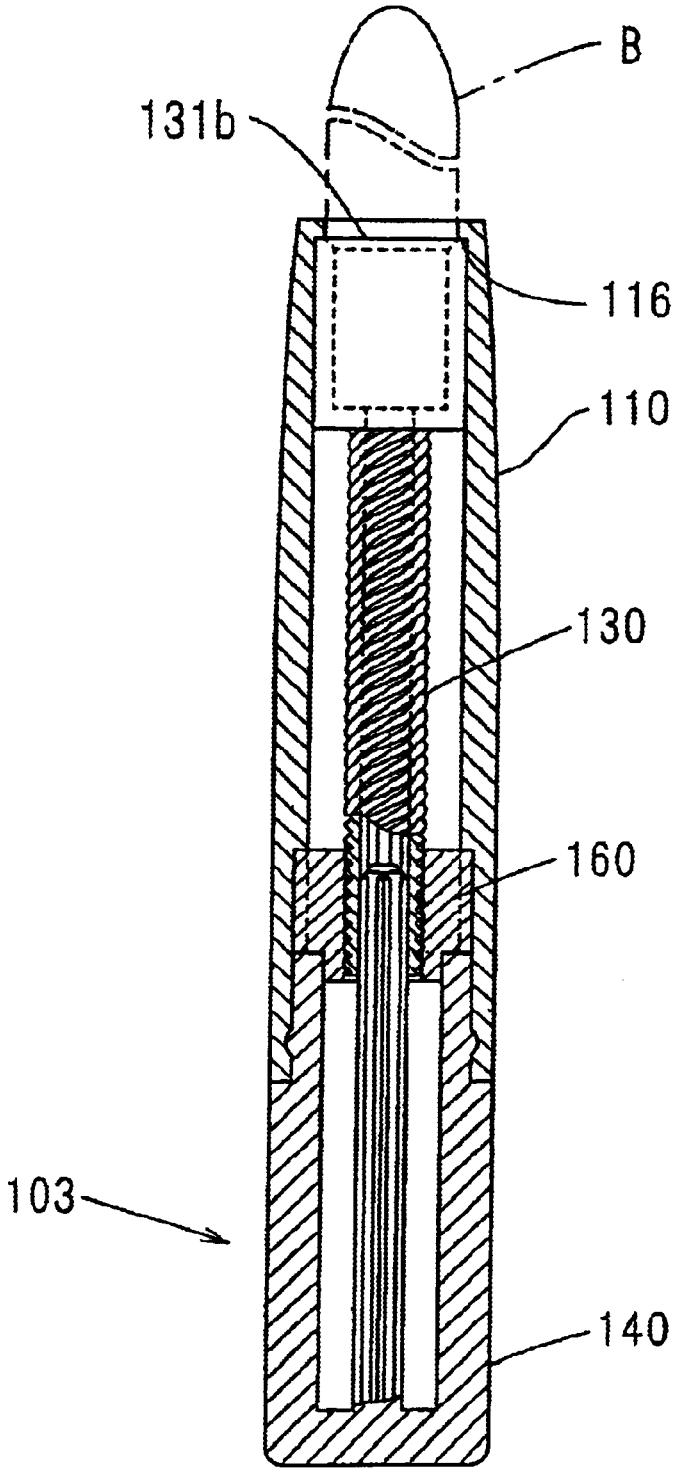
FIG. 11 is a vertical sectional view showing its uppermost limit, similarly.
Figure 12:
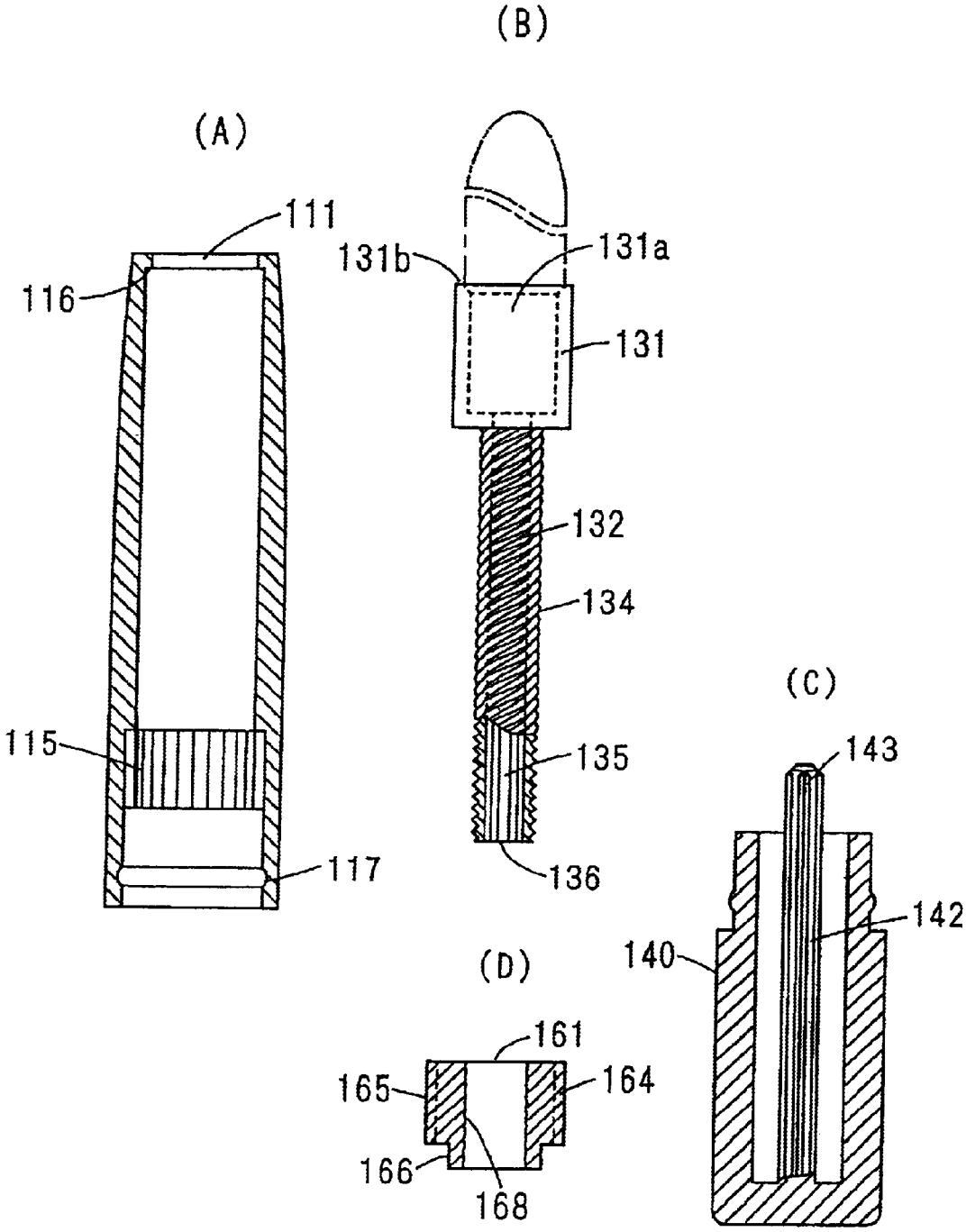
FIG. 12 is an exploded view showing the stick type cosmetic material feeding container according to the second embodiment, and its (A), (B), (C), and (D) are partially vertical sections showing a front cylinder, a core chuck member, an external cylinder, and an elastic cylindrical body, respectively.

FIGS. 10 through 12 show a second embodiment according to the present invention. FIG. 10 is a partially vertical section showing a stick type cosmetic material feeding container 101 in which a core chuck member 130 is located at the lowermost limit. FIG. 11 shows a state that the core chuck member 130 is located at the uppermost limit. FIG. 10 shows respective members used in the second embodiment, such as a front cylinder 110 (A), a core chuck member 130 (B), a container body 103 which has an external cylinder 140 (C), and an elastic cylindrical body 160 (D).

The stick type cosmetic material feeding container 101 according to the second embodiment will be described in detail with reference to FIG. 10.

The stick type cosmetic material feeding container 101 has the front cylinder 110, the container body 103 having the external cylinder 140, the core chuck member 130, and the elastic cylindrical body 160.

As shown in FIG. 12, a cylindrical cosmetic material retaining section 131 having a cavity section 131*a* at its front end is installed at the core chuck member 130. A spiral section 134 composed of a plurality of convex thread spirals is formed at an outer circumference of a rod 132 which coaxially extends from the cosmetic material retaining section 131. Further, at the axial center of the rod 132, a through hole 136 which a plurality of vertical ribs 135 are formed on its inner circumferential surface is installed.

The container body 103 is provided with the external cylinder 140 which a shaft 142 is installed on its bottom surface in a standing position, and an engagement thread section 143 is installed on an outer circumferential surface of the shaft 142.

An elastic cylindrical body 160 has a through hole 161 whose diameter is smaller than an outside diameter of the spiral section 134 of the core chuck member 130. An engagement section 168 is installed on its inner circumferential surface and also a vertical rib 164 is formed at its outer circumference.

The vertical rib 164 of the elastic cylindrical body 160 is engaged with a spline engagement section 115 provided in the front cylinder 110 and the elastic cylindrical body 160 is unrotatably installed at the front cylinder 110. Further, in this embodiment, the engagement section 168 provided on an inner circumferential surface of the through hole 161 of the elastic cylindrical body 160 is formed in a shape of female screw which is formed in the same lead and pitch as those of the male screw of the spiral section 134 of the core chuck member 130 and which is capable of elastic deformation.

Here, an operational state of the stick type cosmetic material feeding container 101 will be described.

When the front cylinder 110 of the stick type cosmetic material feeding container 101 as shown in FIG. 10 is rotated with respect to the container body 103, on the side of the container body 103, the vertical rib 135 of the through hole 136 of the core chuck member 130 is engaged with the engagement thread section 143 formed at the shaft 142, thereby constituting a rotation regulating mechanism.

Further, since the engagement section 168 of the elastic cylindrical body 160 fastened in the front cylinder 110 constitutes a spiral engagement mechanism together with the spiral section 134 of the core chuck member 130, the core chuck member 130 starts moving in an axial direction while rotating with respect to the front cylinder 110. At the same time, a stick type cosmetic material B whose tale section is retained by the cavity section 131*a* of the cosmetic material retaining section 131 starts projecting through a tip opening hole 111 of the front cylinder 110. When the rotation is continued further, the core chuck member 130 reaches the uppermost limit at the time of feeding out as shown in FIG. 11.

The feed-out uppermost limit in the stick type cosmetic material feeding container 101 according to the second embodiment is defined when an upper end section 131*b* of the cosmetic material retaining section 131 comes into contact with a step section 116 provided in the front cylinder 110. When a rotation load is imposed so as to further rise the core chuck member 130, the rod 132 of the core chuck member 130, while it is kept engaged with the shaft 142 which is installed on the bottom surface of the external cylinder 140 in a standing position, starts racing resulting from the elastic deformation of the engagement section 168 provided in the through hole 161 of the elastic cylindrical body 160, thereby preventing the container from being damaged.

The difference between the stick type cosmetic material feeding container 101 according to the second embodiment and the stick type cosmetic material feeding container 1 according to the first embodiment is as follows. In the first embodiment, the stick type cosmetic material A advances and retreats while the front cylinder 10 and the stick type cosmetic material A synchronously rotate, in other words, in a state that the front cylinder 10 and the stick type cosmetic material A do not relatively rotate. On the other hand, in the second embodiment, the stick type cosmetic material B advances and retreats while the front cylinder 110 and the stick type cosmetic material B mutually rotate. In the first embodiment, the stopper member 70 is connected with a rear end of the core chuck member 30, and the uppermost limit is defined when the upper end surface 70*a* of the stopper member 70 comes into contact with the lower end surface of the elastic cylindrical body 60. In order to prevent the cosmetic material retaining section constituted by the claw 39 from being damaged at this time, it is arranged such that the front end section cannot come into contact with a tip of the slide groove 12. On the other hand, in the second embodiment, since intensity can be expected because the cosmetic material retaining section 131 is a cylindrical body having a cavity section, the uppermost limit of the core chuck member 130 is defined when the upper end section 131*b* is caused to come into contact with the step section 116 provided in the front cylinder 110 and the stopper member is not required. Thus, it produces results such that costs and the number of parts can be reduced at the time of assembly.

This embodiment is characterized in that since the stick type cosmetic material B is fed out while rotating with respect to the front cylinder 110, a cubic effect can be produced especially in the case that a molded core is a stick type cosmetic material like a lipstick, thereby being superior to the first embodiment in this point.

As a further feature of this embodiment, the relation of the engagement section 168 formed on an inner circumferential surface of the through hole 161 of the elastic cylindrical body 160 to the rod 132 of the core chuck member 130 and the spiral section 134 is that they are formed as a male screw and a female screw which have identical leads and pitches, and even though such screws having ordinal forms can bring good results, such as racing.

Further, the elastic cylindrical body 160 synchronously rotates with the front cylinder 110 at a front cylinder fitting section 165. Also, since an external cylinder fitting section 166 is inserted in such a manner that the external cylinder fitting section 166 slides while rotating relatively to the external cylinder 140, it is possible to reduce unsteadiness among members at the time of relative rotations of the front cylinder 110 and the external cylinder 140 and it is also possible to give resistance when the front cylinder 110 and the container body 103 relatively rotate.

Figure 13:
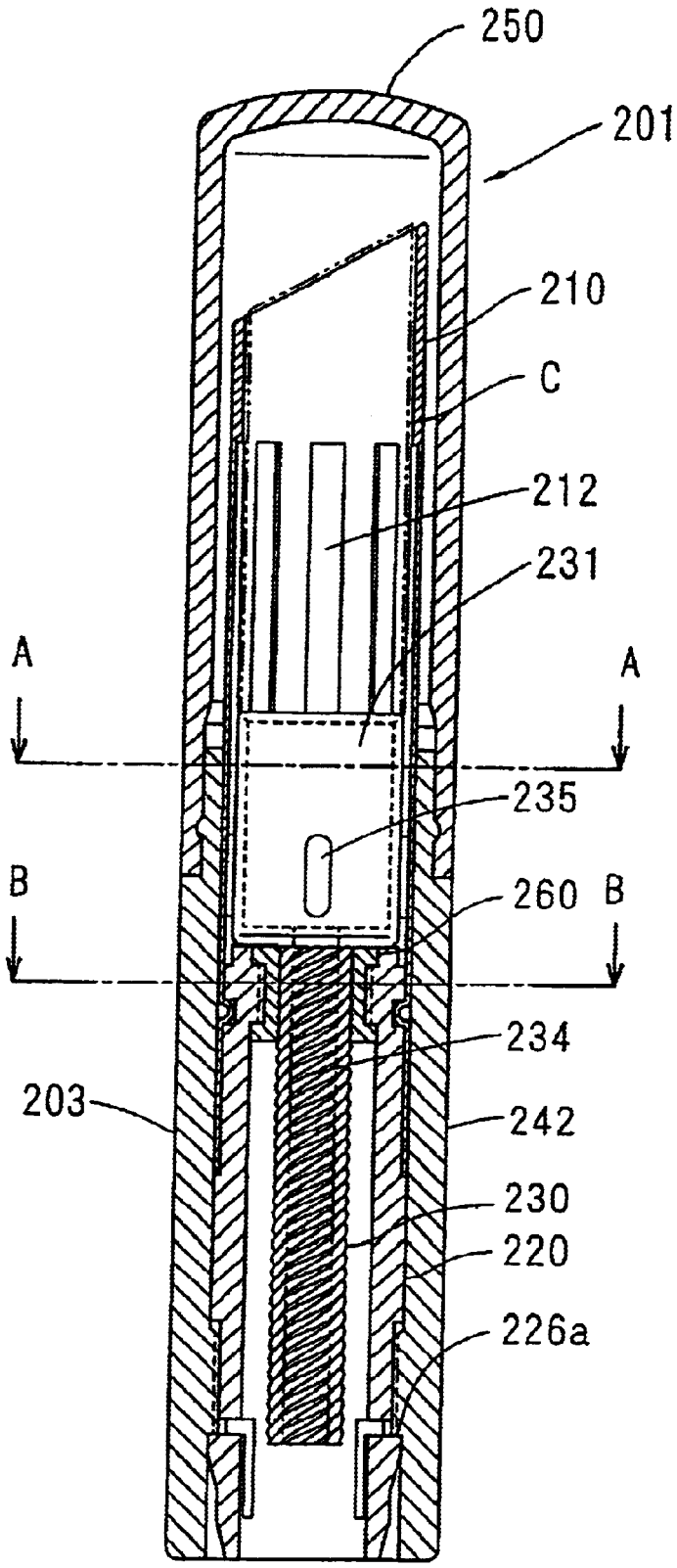
FIG. 13 is a vertical sectional view showing a stick type cosmetic material feeding container according to a third embodiment of the present invention.
Figure 14:
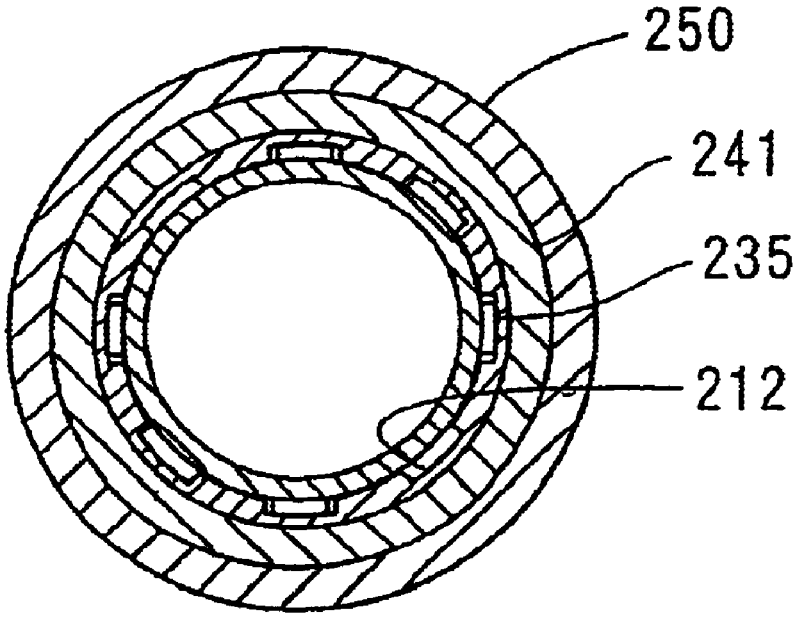
FIG. 14 is a sectional view taken along line A—A shown in FIG. 13.
Figure 15:
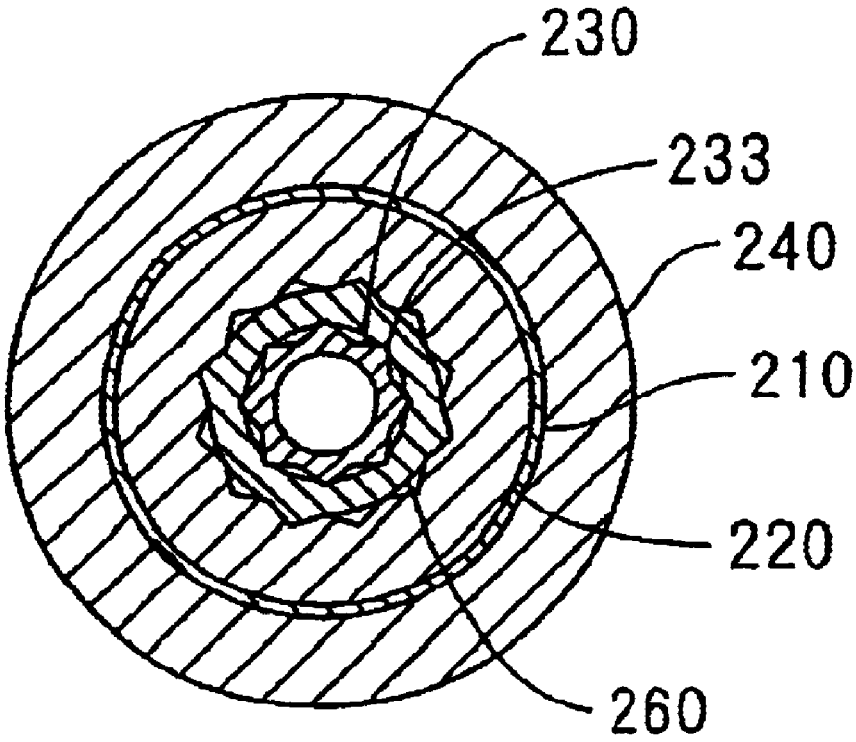
FIG. 15 is a sectional view taken along line B—B shown in FIG. 13.

FIGS. 13 through 22 show a third embodiment of the present invention. FIG. 13 is a partially vertical section showing a stick type cosmetic material feeding container 201 according to the third embodiment. FIG. 14 is a sectional view taken along line A—A of FIG. 13. FIG. 15 is a sectional view taken along line B—B.

Figure 16:
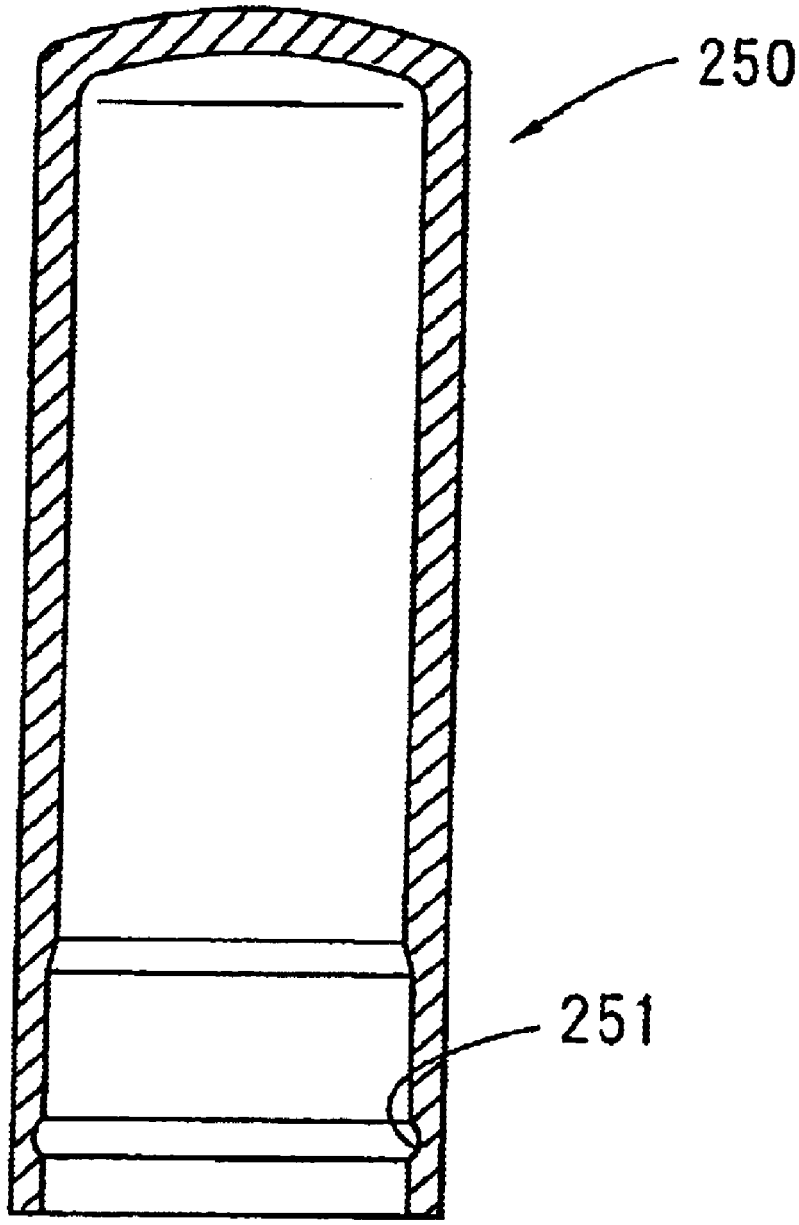
FIG. 16 is a partially vertical section showing a cap according to the third embodiment.
Figure 18:
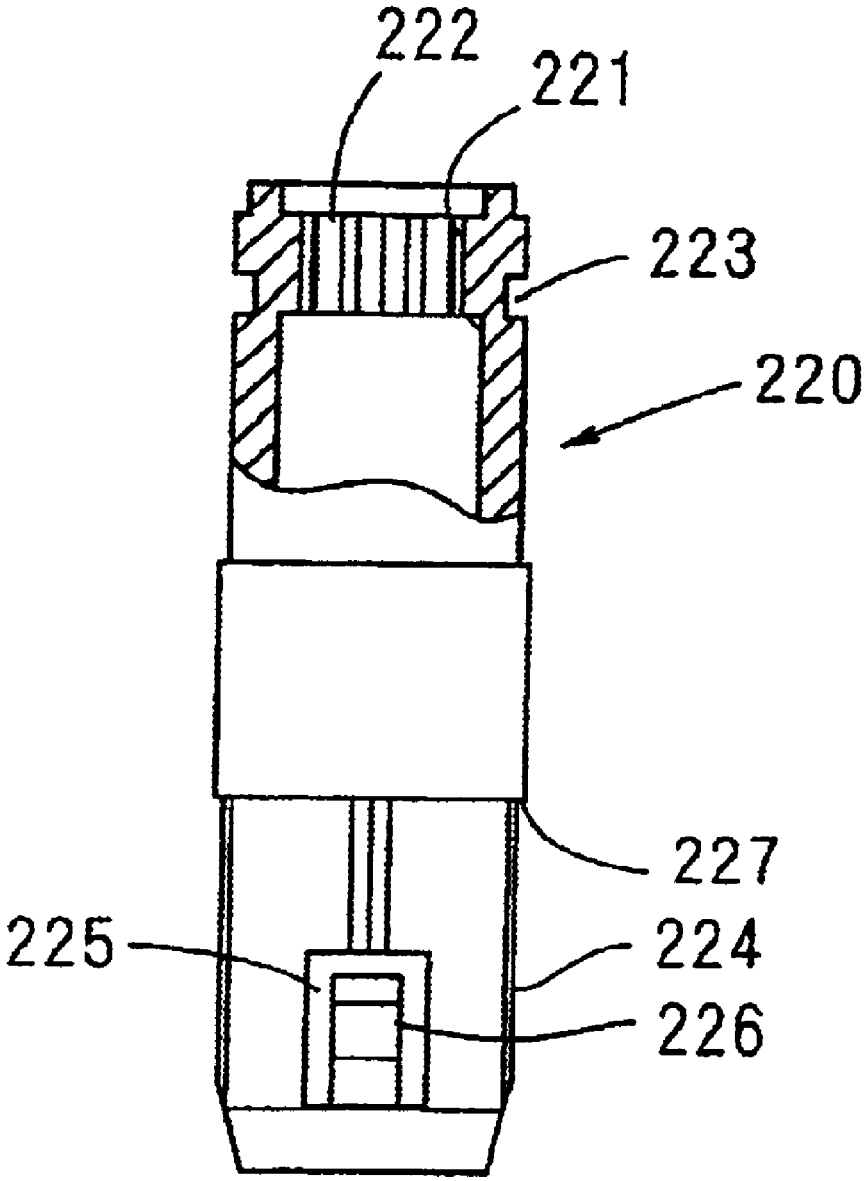
FIG. 18 is a partially vertical section showing a base according to the third embodiment.
Figure 19:
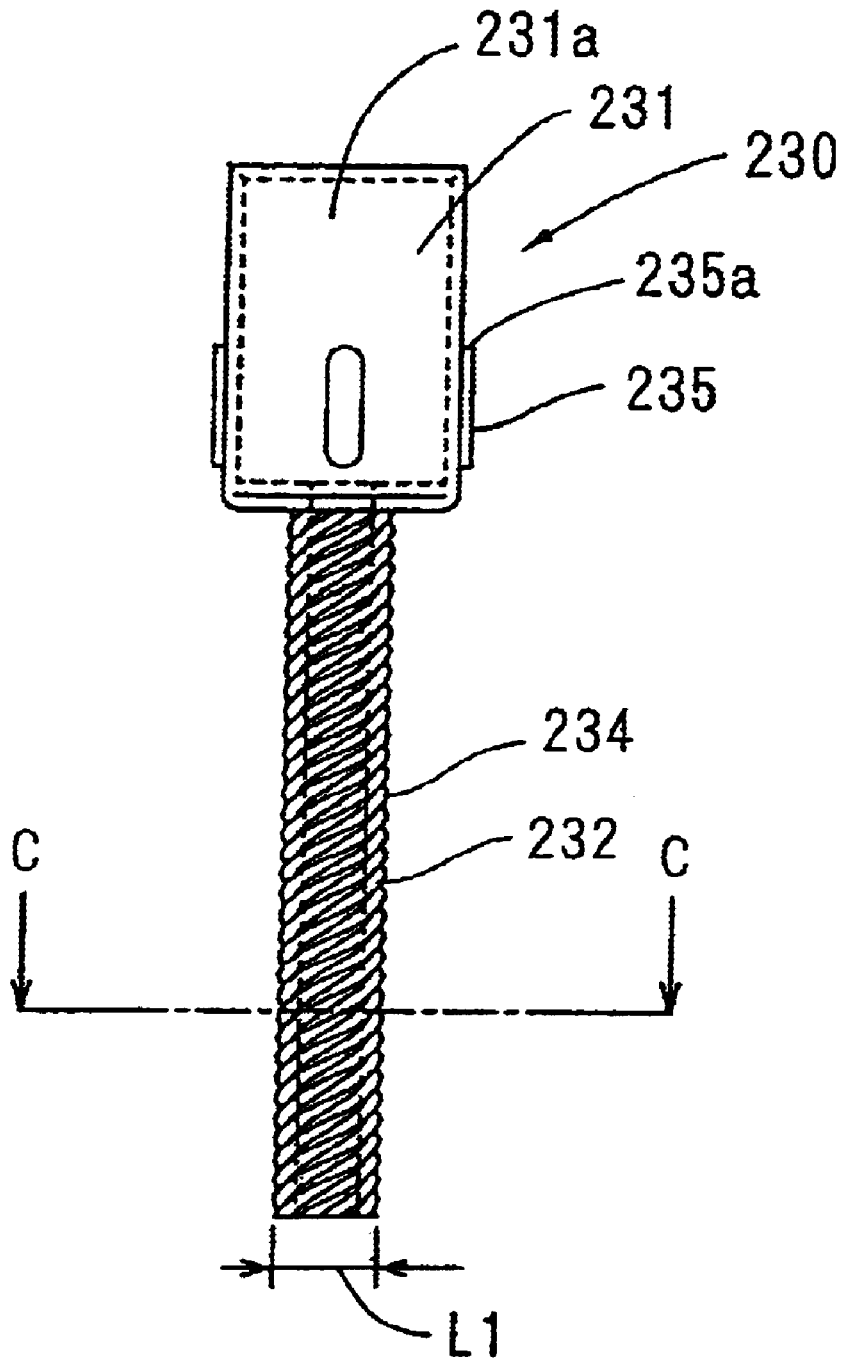
FIG. 19 is a partially vertical section showing a core chuck member according to the third embodiment.
Figure 20:
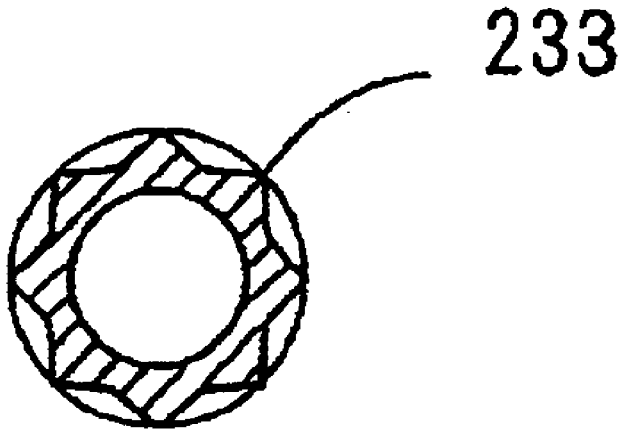
FIG. 20 is a sectional view taken along line C—C shown in FIG. 19.
Figure 21:
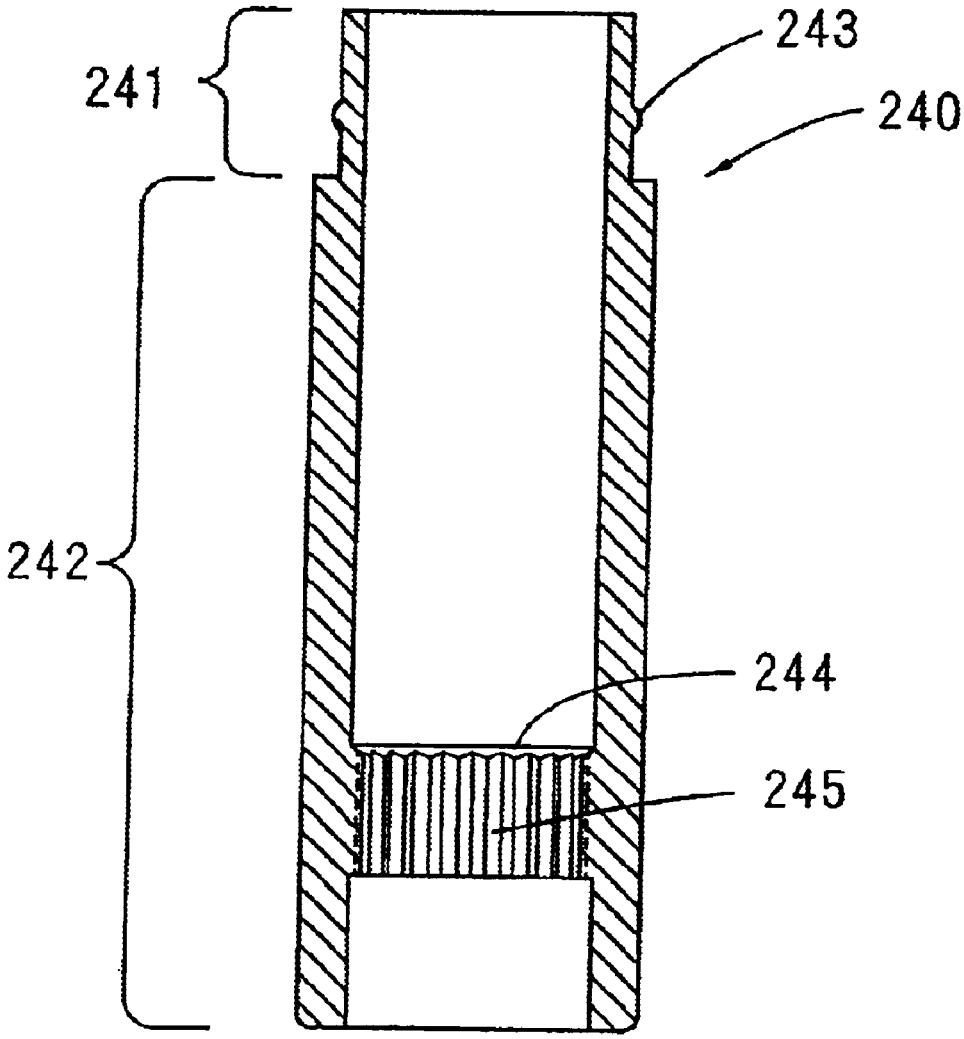
FIG. 21 is a partially vertical section showing an external cylinder according to the third embodiment.

FIGS. 16 through 22 show each member used in the third embodiment. FIG. 16 shows a cap 250, FIG. 17 a front cylinder 210, FIG. 18 a base 220, and FIG. 19 a core chuck member 230, respectively. FIG. 20 is a sectional view taken along line C—C of FIG. 19. FIG. 21 shows an external cylinder 240. Further, FIG. 23 is an elevation showing an elastic cylindrical body 260 to be used in the third embodiment.

The stick type cosmetic material feeding container 201 according to the third embodiment of the present invention will be described in detail with reference to FIG. 13.

The stick type cosmetic material feeding container 201 has the front cylinder 210, the base 220, a container body 203 composed of the external cylinder 240, the elastic cylindrical body 260, the core chuck member 230, and the cap 250.

Similarly to the stick type cosmetic material feeding container 1 according to the first embodiment, the constitution is such that a stick type cosmetic material C advances and retreats while rotating synchronously with the front cylinder 210, and it is assumed that the stick type cosmetic material feeding container 201 is preferably utilized for a lipstick, a concealer, an eye shadow, and the like which have a cap.

Figure 17:
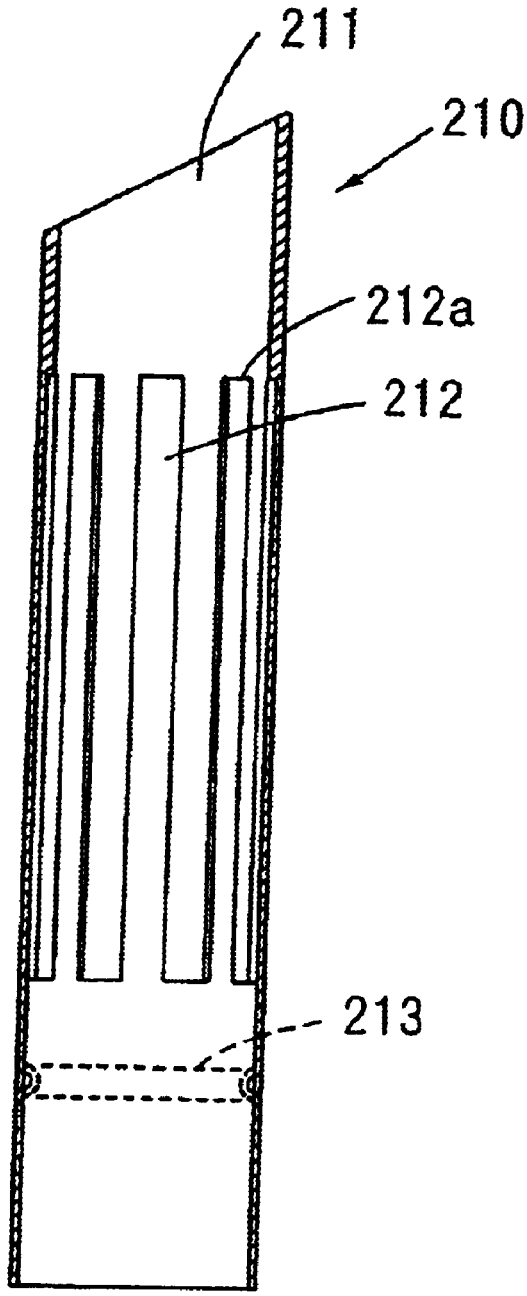
FIG. 17 is a partially vertical section showing a front cylinder according to the third embodiment.

As shown in detail in FIG. 17, the front cylinder 210 is a metallic front cylinder made of aluminum or the like. A plurality of slide grooves 212 are provided in the front cylinder 210 and a lower part of the front cylinder 210 is rotatably connected with the base 220 via a connection projection thread section 213.

The core chuck member 230 shown in FIG. 19 has at its tip a cylindrical cosmetic material retaining section 231 having a cavity section 231*a*, and a spiral section 234 having a convex apex 233 shown in FIG. 20 is formed in an axial direction on a rod 232 which extends from the cosmetic material retaining section 231.

Further, a longitudinal projection 235 is installed at an outer circumference of the cosmetic material retaining section 231 and is engaged with the slide groove 212 of the front cylinder 210, thereby constituting a rotation regulating mechanism.

The container body 203 according to this embodiment differs from the container body 3 of the stick type cosmetic material feeding container 1 according to the first embodiment in that the container body 203 is the external cylinder 240.

As shown in FIG. 21, the external cylinder 240 has a cap stop section 241 and a pinch section 242, and in the external cylinder 240, there are provided a place section 244 on which the base 220 is placed and an spline engagement section 245 which is engaged with a vertical rib 224 formed at an outer circumference of the base 220.

Figure 22:
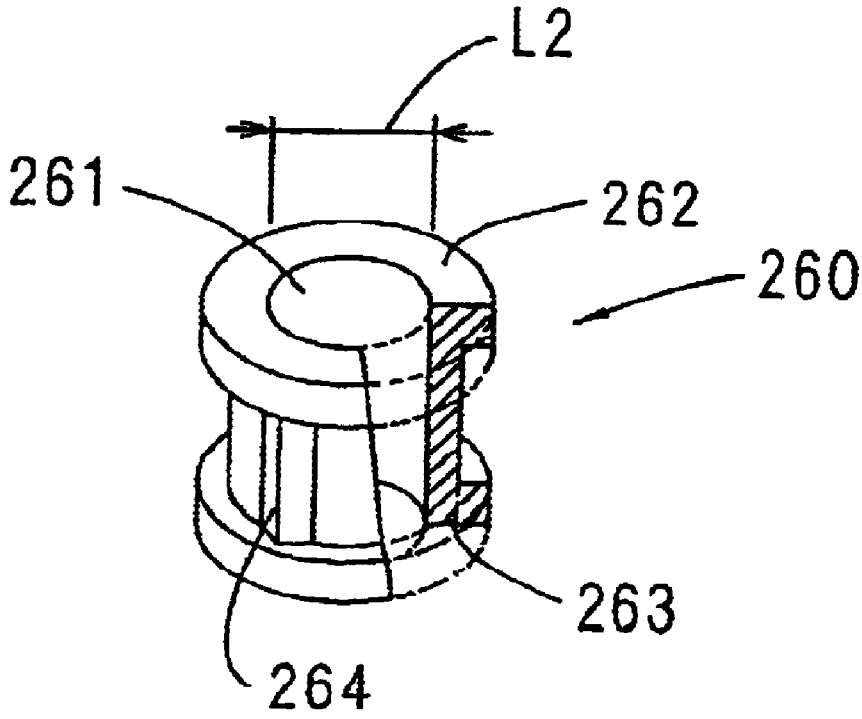
FIG. 22 is an elevation view showing an elastic cylindrical body according to the third embodiment.
Figure 23:
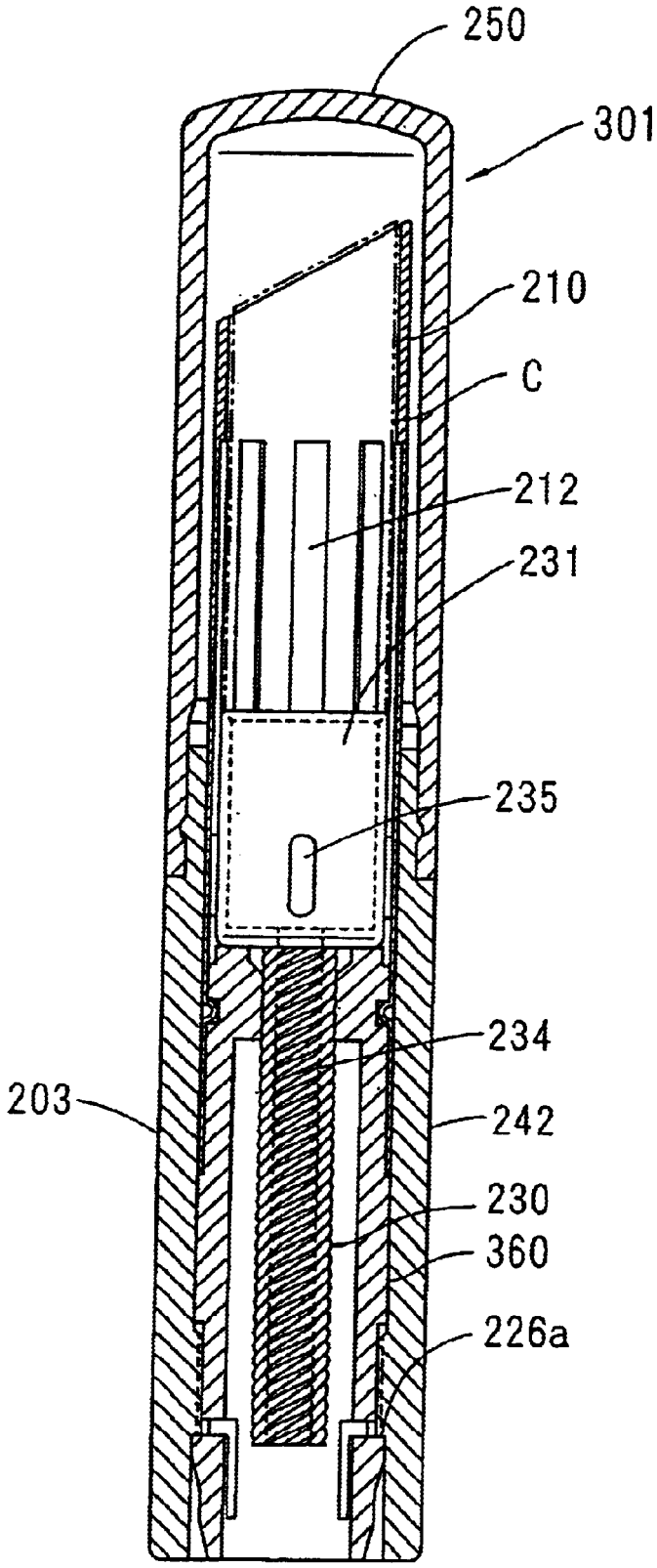
FIG. 23 is a vertical sectional view showing a stick type cosmetic material feeding container according to a fourth embodiment of the present invention.

As shown in FIG. 18, a spline 222 is formed at an inner projection section 221 of the base 220, and the inner projection section 221 is sandwiched and supported by a flange upper end surface 262 and a flange lower end surface 263 of the elastic cylindrical body 260 shown in FIG. 22. Also, by the engagement of a vertical rib 264 and the spline 222, the elastic cylindrical body 260 is stopped so as to synchronously rotate the elastic cylindrical body 260 and the base 220.

In a through hole 261 of the elastic cylindrical body 260, an engagement section 268 which elastic deformation takes place similarly to the first embodiment or the second embodiment is installed, and also it is manufactured such that the size L2 of an inside diameter of the through hole 261 is smaller than the size L1 of an outside diameter of the rod 232 of the core chuck member 230.

Operation according to the third embodiment will be described with reference to FIG. 13.

First, the projection 235 provided at an outer circumference of the cosmetic material retaining section 231 at a tip of the core chuck member 230 is engaged with the slide groove 212 provided in the front cylinder 210, thereby constituting the rotation regulating mechanism. Further, a spiral section 234 of the core chuck member 230 constitutes the spiral engagement mechanism together with the engagement section 268 formed on an inner circumferential surface of the through hole 261 of the elastic cylindrical body 260 which rotates synchronously with the base 220. Thus, when the cap 250 is removed from the container body 203 and the front cylinder 210 is rotated with respect to the pinch section 242 of the external cylinder 240, the feeding mechanism constituted by the rotation regulating mechanism and the spiral engagement mechanism operates. The core chuck member 230 then rotates with respect to the elastic cylindrical body 260 and at the same time starts moving in an axial direction. A stick type cosmetic material C whose tale section is retained by the cavity section 231*a* of the cosmetic material retaining section 231 starts projecting through a tip opening hole 211 of the front cylinder 210.

Further, when the front cylinder 210 and the container body 203 are rotated in a direction reverse to the above, the stick type cosmetic material C retreats to the inside of the front cylinder 210 due to the feeding mechanism.

The feed-out uppermost limit of the stick type cosmetic material feeding container 201 is defined when an upper end section 235*a* of the projection 235 which is formed at an outer circumference of the cosmetic material retaining section 231 provided at a tip of the core chuck member 230 comes into contact with a tip section 212*a* of the slide groove 212 provided in the front cylinder 210.

When turning force to cause further rise of the core chuck member 230 is imposed after the core chuck member 230 reaches the uppermost limit, the rod 232 of the core chuck member 230 easily races in the through hole 261 of the elastic cylindrical body 260 and releases an overload imposed on the stick type cosmetic material feeding container 201, thereby preventing the breakdown.

Similarly to the stick type cosmetic material feeding container according to the first embodiment, the third embodiment is an excellent invention that feeding slide is carried out by the rod 232 of the core chuck member 230 and frictional resistance in the elastic cylindrical body 260 and this provides the sensation of smooth feed-out and slide.

Next, In FIG. 23, a stick type cosmetic material feeding container 301 according to a fourth embodiment of the present invention will be shown. In the fourth embodiment, there is provided an elastic cylindrical body 360 which the elastic cylindrical body 260 and the base 220 according to the third embodiment are formed as one body using an elastic member.

As described above, the elastic cylindrical body 360 is entirely formed using elastic substance and therefore the number of parts can be reduced and it is not necessary to assemble the base and the elastic cylindrical body which are separately installed, thereby improving the productivity.

Incidentally, other constitution is the same as that of the third embodiment, and therefore the identical numeral references will be attached to the corresponding parts and the description of the parts will be omitted.

Figure 24:
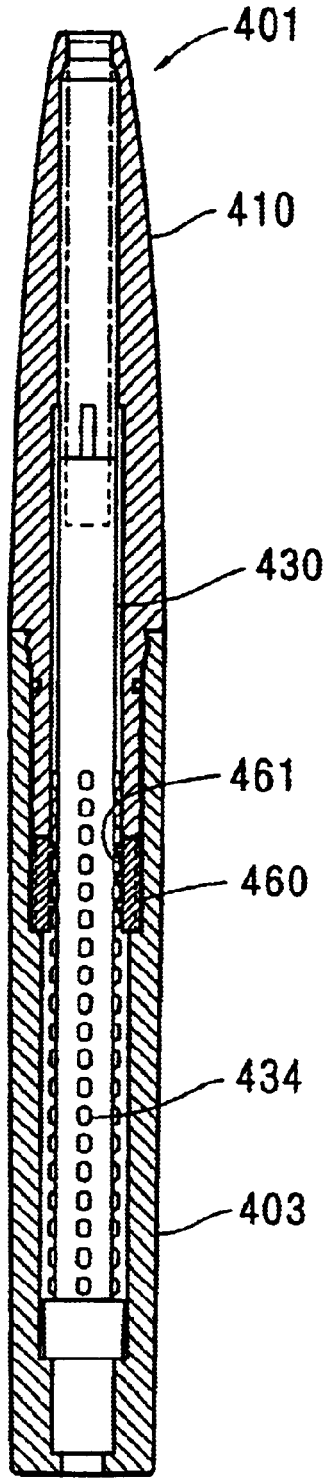
FIG. 24 is a vertical sectional view showing a stick type cosmetic material feeding container according to a fifth embodiment of the present invention.

In FIG. 24, a stick type cosmetic material feeding container 401 according to a fifth embodiment is shown.

In the fifth embodiment, as compared with the first embodiment, an elastic cylindrical body 460 has a spiral groove 461 in which elastic deformation takes place, and a spiral section 434 of a core chuck member 430 is spirally engaged with the spiral groove 461.

The spiral groove 461 is formed on an inner circumference of a through hole of the elastic cylindrical body 460, and the spiral section 434 is constituted by a group of projections arranged at a prescribed interval on a helix of a male screw. It is arranged such that these projections and the spiral groove 461 are spirally engaged. Incidentally, it can be arranged such that there is a space between the spiral groove 464 and the spiral section 434 so as to prevent friction from arising when the core chuck member 430 advances and retreats.

Also in this embodiment, the core chuck member 430 moves due to relative rotations of a front cylinder 410 and a container body 403. When the core chuck member 430 reaches the uppermost limit or the lowermost limit, in other words, when a stopper member 470 comes into contact with a lower surface of the elastic cylindrical body 460 or a bottom surface of the container body 403, the core chuck member 430 races in this position while elastic deformation takes place at the spiral groove 464 due to the spiral section 434. Thus, an overload imposed on the stick type cosmetic material feeding container 401 is released, thereby preventing the breakdown.

Incidentally, the rotation regulating mechanism of the present invention is not limited to the mechanism described in each of the embodiments described above. The mechanism is satisfactory as long as it has means for synchronously rotating the front cylinder and the core chuck member or means for synchronously rotating the container body and the core chuck member. Thus, it goes without saying that various mechanisms can be adopted.

INDUSTRIAL APPLICABILITY

The stick type cosmetic material feeding container according to the present invention avoids an overload at the feed-out uppermost limit and the feed-in lowermost limit and prevents the damage.

What is claimed is:

1. A stick type cosmetic material feeding container in which a stick type cosmetic material is housed, comprising:

a core chuck member having a cosmetic material retaining section for retaining the stick type cosmetic material, and a spiral section which is coaxial with the cosmetic material retaining section, said spiral section having at least one spiral thread formed thereon; and an elastic cylindrical body having a hole therethrough that receives said spiral section, the hole being defined by an elastically deformable inner circumferential surface that elastically deforms, due to engagement with the spiral thread of said spiral section, to form a corresponding spiral thread in the inner circumferential surface only when said spiral section is received by the hole, wherein the stick type cosmetic material is fed out using the core chuck member due to relative rotations of the elastic cylindrical body and the core chuck member.

2. A stick type cosmetic material feeding container according to claim 1, wherein the spiral section of the core chuck member is a multiple-threaded male screw.

3. A stick type cosmetic material feeding container according to claim 2, wherein the spiral section of the core chuck member presses the inner circumferential surface, thereby forming the corresponding spiral thread.

4. A stick type cosmetic material feeding container according to claim 1, wherein when the hole does not have said spiral section received therein, the inner circumferential surface is free of threads and projections.

* * * * *